US011511180B2

(12) United States Patent
Braden

(10) Patent No.: US 11,511,180 B2
(45) Date of Patent: Nov. 29, 2022

(54) SKATEBOARD TRUCK ASSEMBLY

(71) Applicant: BRADEN BOARDS, LLC, Hollister, MO (US)

(72) Inventor: Jared Dane Braden, Branson, MO (US)

(73) Assignee: BRADEN BOARDS, LLC, Hollister, MO (US)

( * ) Notice: Subject to any disclaimer, the term of this patent is extended or adjusted under 35 U.S.C. 154(b) by 0 days.

(21) Appl. No.: 17/174,823

(22) Filed: Feb. 12, 2021

(65) Prior Publication Data

US 2021/0245034 A1 Aug. 12, 2021

Related U.S. Application Data

(60) Provisional application No. 62/975,635, filed on Feb. 12, 2020.

(51) Int. Cl.
*A63C 17/01* (2006.01)

(52) U.S. Cl.
CPC ..... *A63C 17/012* (2013.01)

(58) Field of Classification Search
CPC ..... A63C 17/012
See application file for complete search history.

(56) References Cited

U.S. PATENT DOCUMENTS

| | | | | |
|---|---|---|---|---|
| 8,888,108 | B1 * | 11/2014 | Beaty | A63C 17/012 280/11.27 |
| 9,010,777 | B2 * | 4/2015 | Braden | A63C 17/265 280/87.041 |
| 2017/0203193 | A1 * | 7/2017 | Powell | A63C 17/0093 |
| 2019/0232152 | A1 * | 8/2019 | Lininger, Jr. | A63C 17/0046 |
| 2020/0179791 | A1 * | 6/2020 | Williams, Jr. | A63C 17/015 |
| 2020/0283065 | A1 * | 9/2020 | Chaput | B62D 7/18 |
| 2021/0052970 | A1 * | 2/2021 | Tyler | A63C 17/012 |

* cited by examiner

*Primary Examiner* — Brian L Swenson
(74) *Attorney, Agent, or Firm* — Shook, Hardy & Bacon L.L.P.

(57) ABSTRACT

A customizable skateboard truck assembly comprising an adjustable base plate and a hanger with both adjustable rake and ride height. Further, the skateboard truck assembly disclosed utilizes an open bushing platform that allows for unlimited shapes to be used for the bushing relative to its perimeter. The added space between the hanger and the baseplate allows the truck assembly to fit multiple bushing thicknesses while also choosing to maintain or change the hardness for the bushing. The thickness, hardness, and shape of the bushing all have an effect on the truck assembly's responsiveness and feel for the user. Additionally, the truck assemblies comprise adjustable cams for regulating rotation, or in other words, providing a maximum angle of rotation to the hanger to avoid wheel bite, thereby increasing safety an control of the skateboard by the user. The customizable skateboard truck assembly facilitates smooth and precise motion of the skateboard.

15 Claims, 15 Drawing Sheets

SKATEBOARD TRUCK ASSEMBLY

CROSS-REFERENCE TO RELATED APPLICATION(S)

The application claims priority to Provisional Application No. 62/975,635, filed on Feb. 12, 2020, incorporated herein by reference.

STATEMENT REGARDING FEDERALLY SPONSORED RESEARCH OR DEVELOPMENT

Not applicable.

TECHNICAL FIELD

This invention generally relates to a customizable skateboard truck assembly that utilizes rotational motion to facilitate maneuverability of a skateboard. In another aspect, the invention relates to a skateboard employing one or more inventive truck assemblies. Embodiments include aspects or components of a truck assembly, such as a hanger, for example including one or more adjustable axles, an adjustable member, a cam, and/or a kingpin. In some cases one or more aspects of a truck assembly in accordance with embodiments of the present invention are implemented with one or more components of a non-customizable truck assembly.

BACKGROUND OF THE INVENTION

In addition to, for example, securing the wheels of a skateboard to its deck, the skateboard truck assembly can play a role in the overall maneuverability of the skateboard, including, the rider's ability to control the direction of the board's travel. Several types of skateboard trucks exist and its ultimate design is subject to variation. However, in general, most truck assemblies tend to operate on the basic principle that a change in the rider's position on the board (e.g., through a shift in weight or "pumping" of one's legs) can be at least partially translated to a change in the direction of the skateboard's motion. Many conventional truck assemblies, however, exhibit a variety of drawbacks that can adversely impact the operation of the skateboard—both in terms of rider flexibility, performance, and in some cases, rider safety. For example, conventional trucks place an extreme amount of stress on the reverse kingpin, which can oftentimes result in failed or broken parts, which create a hazardous situation for the rider.

Additionally, many traditionally-designed skateboard trucks geometrically limit the skateboard's turning ability, which can be the method used to slow the skateboard down when riding on uneven or sloped (e.g., mountainous) terrain. Conventional trucks can only exhibit a tighter turning radius when the truck is loosened, which consequently reduces stability, especially at high speeds. This is extremely dangerous, as it can cause "speed wobble," which can result in severe injury or even death. Thus, a need exists for a robust, yet versatile, skateboard truck design that improves or maximizes the turning ability and performance of the skateboard, in some cases while retaining a suitable degree of stability and, ultimately, enhancing both rider control and safety.

BRIEF SUMMARY OF THE INVENTION

One embodiment of the present invention concerns a skateboard truck assembly comprising an adjustable base plate and a hanger with adjustable rake and adjustable ride height. The base plate comprises a mounting plate and an angled coupling member extending from the mounting plate. The skateboard truck assembly is configured to be mounted on a skateboard deck by the mounting plate. Unlike conventional skateboard trucks, the skateboard truck in accordance with embodiments herein includes an adjustable member configured to be coupled to the angled coupling member of the base plate. The adjustable member comprises a mating portion that couples to a track of the angled coupling member. The adjustable member can be coupled to the angled coupling member at one or more positions along the track of the angled coupling member. The different positions along the track of the angled coupling member change an angle formed between the kingpin and the mounting plate, thereby allowing a user to adjust (i.e., customize) the skateboard truck angle to their liking. For instance, the skateboard truck angle allows the user to adjust how much the skateboard truck turns when compared to its lean. In other words, a high skateboard truck angle (e.g., about 48 to 50 degrees) allows the user to make a turn leaning less than what would be required with a low skateboard truck angle (e.g., about 44 degrees or less, 34 degrees or less, 24 degrees or less), which is also accomplished by partial rotation of the hanger between a resting position and a turning position about an axis defined by a longitudinal axis of the kingpin. In embodiments, axial rotation of the hanger can be limited in one-degree increments, or two-degree increments, as examples.

Further, unlike traditional fixed hangers, the truck assembly in accordance with embodiments herein includes adjustable axles resulting in the ability to change both rake and ride height with the same components. Rake, as used herein, is the relationship between the longitudinal axis of the axle and the center of the rotational axis of the kingpin. Rake gives the user control over how quickly or slowly the truck assembly turns relative to the tilt of the skateboard deck, resulting in how nimble and responsive the truck assembly reacts to the user's ankle articulation, in embodiments.

Additionally, unlike conventional truck assemblies, the truck assembly in accordance with embodiments herein includes adjustable cams that limit the amount of axial rotation of the hanger, resulting in reduced or zero "wheel bite." The diameter of the wheel, the shape of the skateboard deck, the ride height, and the angle of the kingpin with respect to the skateboard deck or mounting plate of the base plate, can all affect where the hanger should stop its rotation.

Further, at least one compressible member (i.e., bushing) is positioned between the adjustable member and the hanger, which is configured to experience at least one compression zone and at least one tension zone when the hanger is in the turning position, in embodiments. Unlike conventional skate bushings, the bushings in accordance with aspects herein include an open platform from which the inner and outer perimeter of the bushing can be a myriad of shapes creating a different feel for the rider from linear to progressive. The open platform also allows for further customization of the truck assembly, in exemplary embodiments, by allowing different thicknesses to be used for the bushing that further allow the truck assembly to provide proper leverage to the rider and their weight.

BRIEF DESCRIPTION OF THE SEVERAL VIEWS OF THE DRAWINGS

Various embodiments of the present invention are described in detail below with reference to the attached drawing figures, wherein.

DETAILED DESCRIPTION OF THE INVENTION

Figure 1A:
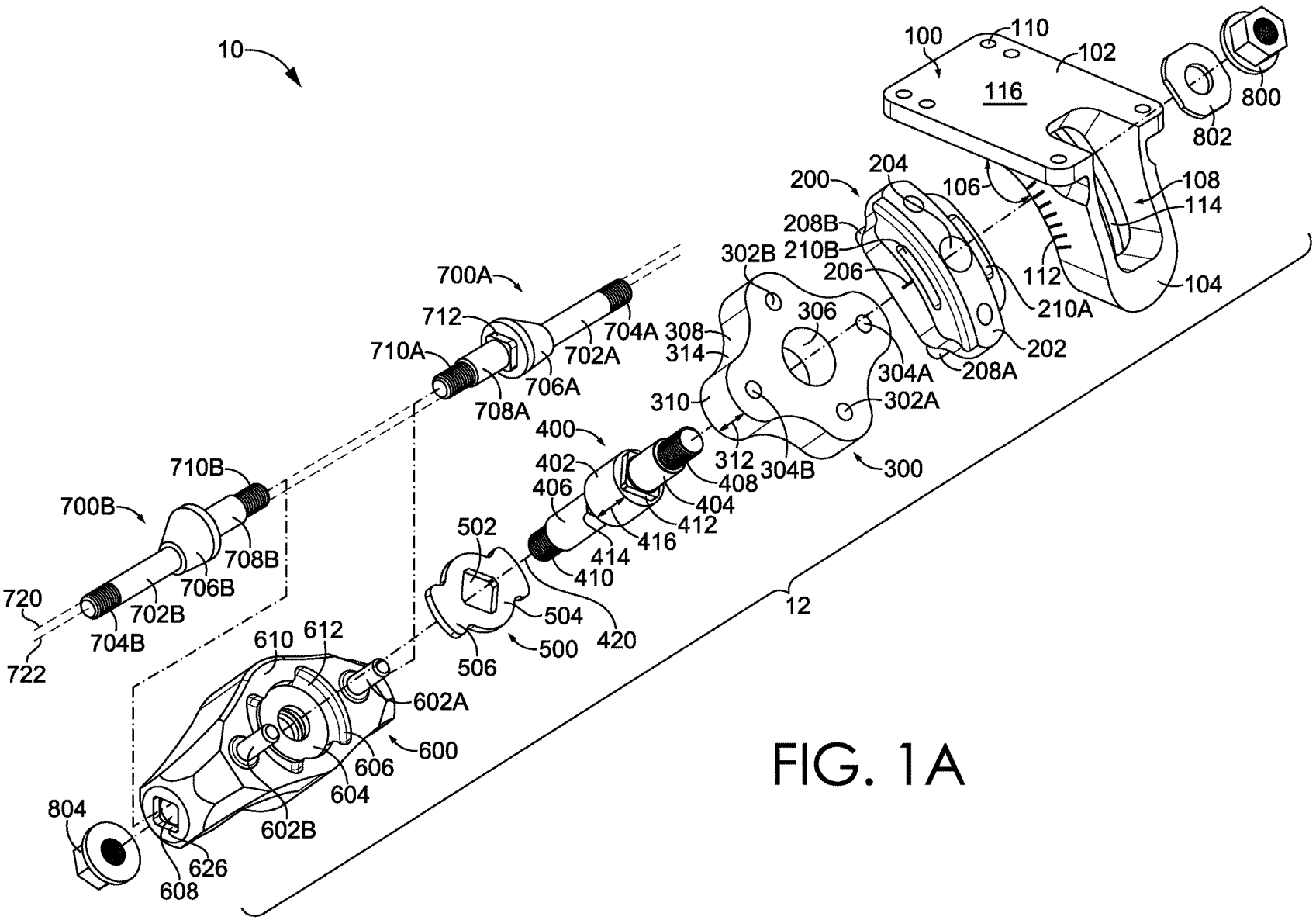
FIG. 1A depicts a first isometric assembly view of a skateboard truck, in accordance with aspects herein.

Referring now to the Figures in more detail, like numerals indicate like parts in all views. Turning initially to FIG. 1A, an isometric assembly view 10 of a truck assembly 12 for skateboards, is shown. The truck assembly 12 can be operable to fasten or attach at least one wheel assembly (i.e., a pair of wheels 920A and 920B shown as environment in FIGS. 8A to 9D) to a skate deck (shown as 910 in environment form in FIGS. 8A to 9D) of a skateboard. In addition, truck assembly 12 can also function as a turning mechanism, at least partially facilitating the transfer of rider-generated energy into motion and, in particular, directional motion, of a skateboard.

The truck assembly 12 comprises a base plate 100, a hanger 600, and at least one compressible member 300 that is at least partially interposed between base plate 100 and the hanger 600. The base plate 100 can be configured to be mounted to a skate deck via a mounting plate 102, which presents a substantially planar interface surface 116 configured to interface with the underside of a skate deck and be secured to it by inserting a plurality of screws or other like suitable securing mechanisms through the plurality of openings 110 extending through the mounting plate 102. The base plate 100 further comprises an angled coupling member 104 extending from the mounting plate 102 at an angle 106, which can range between 0° and 90°. The angled coupling member 104 comprises an open track 114 on one surface and a cavity 108 on the opposite surface. Further, the angled coupling member 104 may include a plurality of positional markings 112 on at least one side of the angled coupling member 104.

The open track 114 of the angled coupling member 104 is specifically configured to receive and mate with an adjustable member 200. The adjustable member 200, for instance, includes a mating portion 202 extending from one surface that is configured to snuggly fit within the open track 114 of the angled coupling member 104. Further, the adjustable member may include an indicator marking 206 on at least one side of the adjustable member 200, which is configured to indicate a position of the adjustable member 200 with respect to the angled coupling member 104 by aligning with one or falling between a pair of the positional markings 112 of the angled coupling member 104.

To aid in the mating and releasing, as well as tight fit and cushioning of the adjustable member 200 with the angled coupling member 104, the adjustable member 200 may optionally include a pair of rubber or like material (e.g., silicone, thermoplastic polyurethane, neoprene, urethane, etc.) strips 210A and 210B on either side of the mating portion 202. The strips 210A and 210B may be fitted into grooves, for example, ⅛ inch grooves (or wider or narrower grooves) that extend at least partially along the length of the mating portion 202 on either side of the mating portion. Although strips 210A and 210B are optional, when present, they may provide friction between the adjustable member 200 and the angled coupling member 104 such that when mated together, the adjustable member 200 is prevented from slipping or moving with respect to the angled coupling member 104. Furthermore, the adjustable member 200 includes a central opening 204 that also extends through the mating portion 202. The central opening 204 is configured to receive the kingpin 400 through it. Further, the adjustable member 200 also comprises a pair of pins 208A and 208B extending from the opposite surface from which the mating portion 202 extends. The pins 208A and 208B are configured to mate with openings 302A and 302B, respectively of a compressible member 300.

The compressible member 300 (i.e., bushing) may be of a desired thickness 312 suitable to permit movement of hanger 600. The compressible member 300 can be a non-circular symmetrically shaped element. The thickness 312 of the compressible member 300 may be in a range between 0.25 inches and 2.5 inches, or between 0.5 inches and 2 inches, although other thicknesses may be contemplated. In some embodiments, compressible member 300 can be made of a material having a Shore A hardness (ASTM D-2244) in the range of from about 50 to about 100, about 60 to about 95, about 75 to about 90, or about 80 to about 97, including, for example, one or more elastomers. Polyurethane is one example of a suitable elastomer from which compressible member 300 can be constructed. Other materials may include, rubber, silicone, urethane, neoprene, thermoplastic polyurethane, and the like, or a combination of two or more of these and other materials that would be suitable. In some cases, the hardness of compressible member 300, the thickness (and/or whether uniform or variable), and/or the shape of compressible member 300 can impact the responsiveness and operation of truck assembly 12. According to some embodiments, at least a substantial portion of the total volume of the compressible member 300 can be completely or almost completely interposed between base plate 100 and the hanger 600, while at the same time, can also be substantially exposed, thereby allowing compressible member to free-form as required, as will become apparent with respect to FIG. 1B. This embodiment is in contrast to many conventional skate trucks, which include enclosures or housings for encompassing the truck bushing.

As briefly described above, and as shown, the compressible member 300 comprises a non-circular symmetrical shape. For instance, in FIG. 1A, it can be seen that the non-circular symmetrical shape is a shape having a perimeter 314 comprised of grooves 308 and ridges 310 that cooperate to form a quatrefoil shape. In one aspect, the grooves 308 and ridges 310, may be optionally rounded, as shown. The ridges 310 provide space for openings 302A, 302B, 304A, and 304B, while the grooves 308 provide space for the compressible member 300 to bend and stretch as necessary when the hanger 600 is turning. Just as the openings 302A and 302B are configured to receive pins 208A and 208B, respectively of adjustable member 200, openings 304A and 304B are configured to receive pins 602A and 602B of the hanger 600, thereby locking the compressible member 300 to both the adjustable member 200, and the hanger 600, simultaneously. Although the adjustable member 200 is depicted as having a pair of pins 208A and 208B, and the hanger 600 is depicted as having a pair of pins 602A and 602B, it is contemplated that the adjustable member 200 may only comprise one pin and the hanger 600 may also only comprise one pin such that the pins of the adjustable member 200 and the hanger 600 are offset from one another when the truck assembly 12 is in an assembled state. Likewise, it is also contemplated that the adjustable member 200 and the hanger 600 may each comprise more than two pins such that the pins of the adjustable member 200 and the hanger 600 are offset from one another when the truck assembly 12 is in an assembled state. Further, the central portion of the compressible member 300 provides space for a central opening 306 configured to receive the kingpin 400 through it, as will become more apparent with respect to FIGS. 3A and 3B.

In an exemplary embodiment, the kingpin 400 is a single piece having a core portion 402 from which a first rod portion 404 and a second rod 406 extend in opposite directions from the core portion 402. The first rod portion 404 is configured to fix the adjustable member 200 to the base plate 100 through a nut 800 and a washer 802 that screws to the tip 408. The second rod 406 is longer than the first rod portion 404, and is configured fix the hanger to the base plate 100 through a nut 804 that screws to the tip 410. As shown, the core portion 402 of the kingpin 400 has a diameter that is larger than the diameter of the first rod portion 404 and the second rod 406, to accommodate a straight edged lip portion 412 at the base of the first rod portion 404 and another straight edged lip portion 414 at the base of the second rod 406. The straight edged lip portion, although shown as square, may be any suitable geometrical shape such as hex, triangle, star, etc. A height 416 of the core portion 402 may generally correspond to a thickness 312 of the compressible member 300 such that when the kingpin 400 is extended through the central opening 306 of the compressible member 300, the core portion 402 of the kingpin 400 is substantially concealed by the compressible member 300, as can be seen in FIGS. 3B and 3C. In accordance with aspects herein, the core portion 402 of the kingpin 400 is configured to extend through the central opening 306 of the compressible member 300. Further, the straight edged lip portion 412 is configured to mate with a corresponding straight edged groove 214 (shown at FIG. 2A) of the adjustable member 200 to lock rotation of the kingpin 400 with respect to the adjustable member 200. Similarly, the straight edged lip portion 414 is configured to mate with a straight edged central opening 502 of a cam 500 to limit rotation of the hanger, via the cam 500, as will be described below. In other words, when the hanger 600 is rotated, the kingpin 400 remains stationary (i.e., does not rotate) with respect to the base plate, in embodiments of the present invention.

The cam 500 functions as a key that is configured to fit within a groove 606 of the hanger 600. The groove 606, as shown, is centered within a first surface of the hanger 600 that is configured to face the compressible member 300. The groove 606 is shaped to accept the cam 500 with enough clearance to allow the cam 500 to at least partially rotate about the longitudinal axis 420 of the kingpin 400. Area 604 can be part of groove 606, in embodiments, or a space between or near portions of groove 606, as shown in FIG. 1A, in embodiments. As described above, the kingpin 400 comprises the straight edged lip portion 414 that is configured to fit within the straight edged central opening 502. Although the straight edged lip portion 414 of the kingpin 400 and the straight edged central opening 502 are shown as having a square shape, as described above, the locking straight edged shape that locks the cam 500 to the kingpin 400 may include any suitable straight edged geometrical shape such as triangle, hexagon, octagon, etc. The groove 606 generally comprises a circular middle portion 610 with a pair of projections 612 that extend from the circular middle portion 610 opposite to one another. In another example (not shown), only one projection may extend from the circular middle portion 610. As shown, the one or more projections may be optionally rounded. The cam 500 may be similarly shaped with a circular middle portion 504 and a pair of projections 506 extending from the circular middle portion 504 opposite to one another, as shown. However, if the groove 606 only comprises one projection (e.g., one of projections 612), it is to be understood that the cam 500 would be correspondingly shaped to fit within the groove 606 with only one projection 506.

Figure 3A:
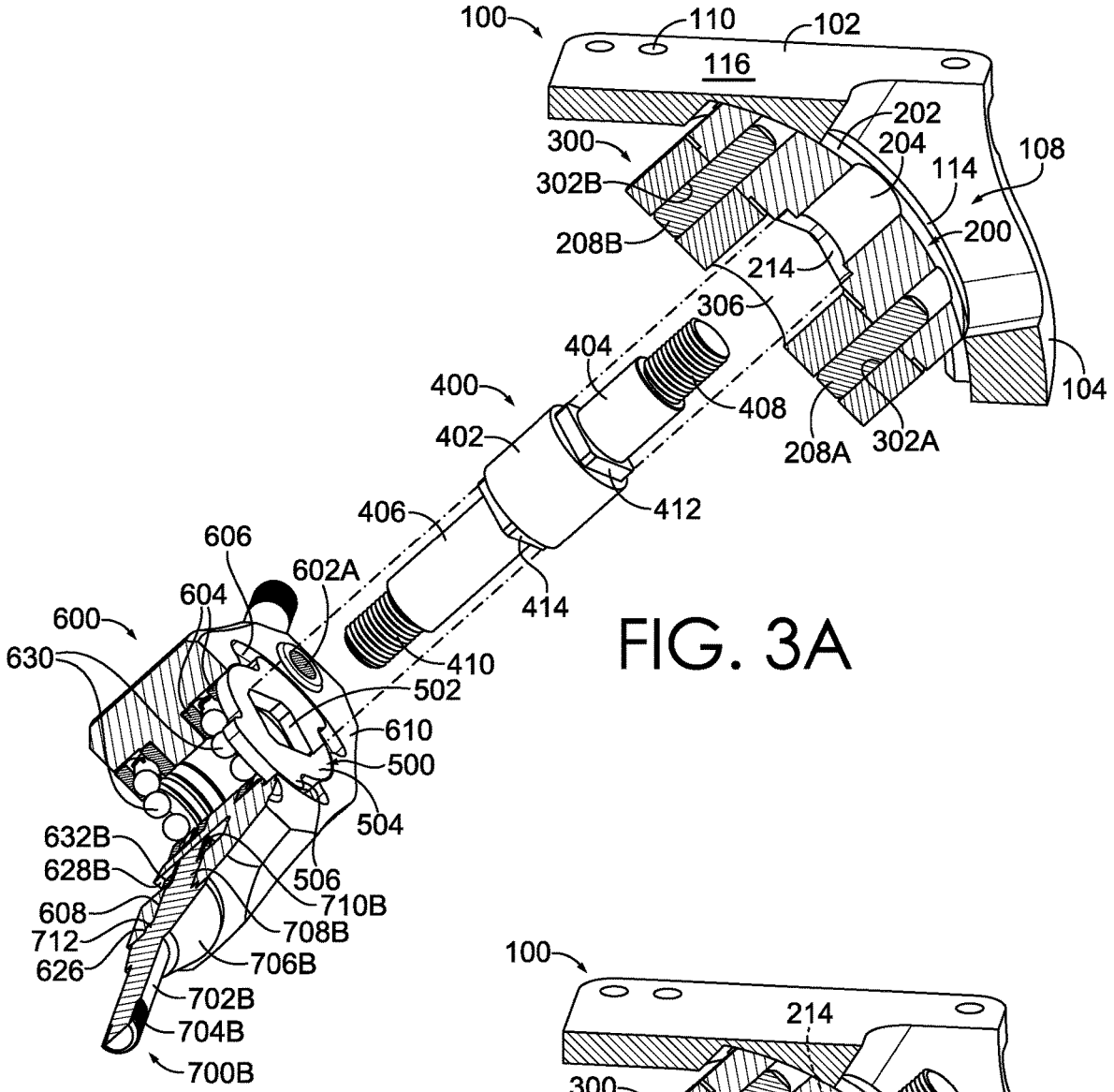
FIGS. 3A-3C depict different cutout and cross-sectional views of the skateboard truck assembly, in accordance with aspects herein.
Figure 3B:
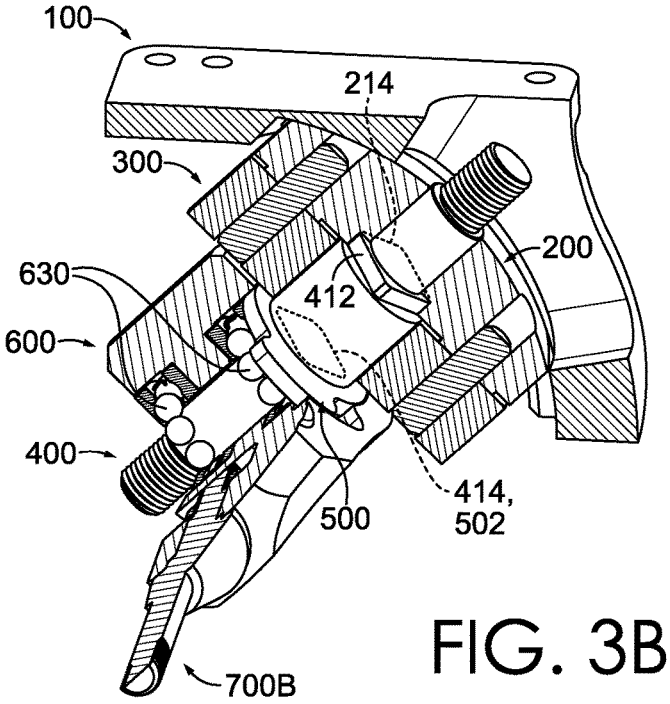
Figure 4A:
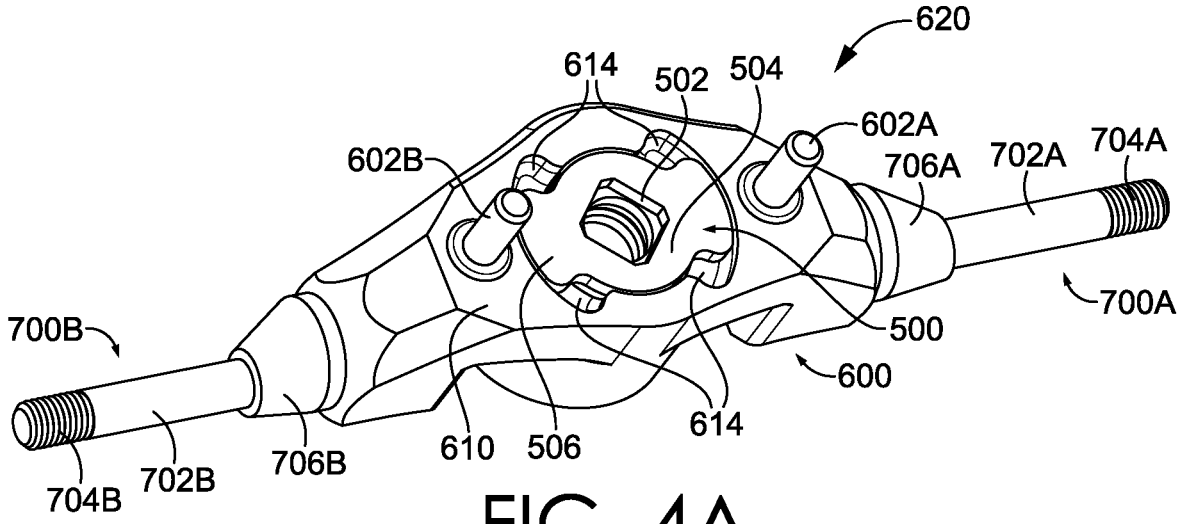
FIGS. 4A-4C depict a keyed cam system of the skateboard truck assembly, in accordance with aspects herein.

Moving back to FIG. 1A, the circular middle portion 504 of the cam 500 is configured to closely fit within the circular middle portion 610 of the groove 606 with just enough clearance to allow the circular middle portion 504 of the cam 500 to freely rotate about the longitudinal axis 420 of the kingpin 400 to the extent allowed by the projection(s) 612 of the groove 606. That is, the pair of projections 506 of the cam 500, are narrower (i.e., slimmer) than the pair of projections 612 extending from the circular middle portion 610 of the groove 606 such that a pair of gaps 614 are present between each of the pair of projections 506 and the pair of projections 612 of the groove 606 when the hanger 600 is in a neutral state 620, as shown in FIG. 4A. It is to be noted that the pair of projections 506 of the cam may or may not be optionally rounded, as shown. As described above, the functionality of the cam 500 is the same when only one projection on cam 500 (e.g., one projection 506) and/or one projection associated with hanger 600 (e.g., one projection 612) is used. For example, instead of the projections being oriented along an axis that is parallel to an axis 722 of the of the adjustable axle bodies 700A and 700B, the single projection may be oriented orthogonal to axis 722 to provide the same functionality as the pair of projections 506. This configuration provides a key and lock type fit of the cam 500 with respect to the hanger 600. The keyed configuration of the cam 500, and in particular the pair of gaps 614 formed between the cam 500 and the groove 606 of the hanger 600, give the hanger 600 a limited rotational mobility to prevent the hanger 600 from rotating beyond a desired threshold, which could create a dangerous situation for the user, in embodiments. As can be observed from the illustrative examples in FIGS. 4B and 4C, as the hanger 600 turns one way or the other, the size balance between the pair of gaps 614 changes accordingly, wherein at the hanger turn limit one way or the other, only one gap 616 (shown in FIG. 4B) or 618 (shown in FIG. 4C) that is double the width of one gap 614 is formed between the cam 500 and the groove 606 of the hanger 600. To the extent the hanger 600 is allowed to rotate, a smooth, frictionless rotation is provided by the bearing member 630 housed within the hanger 600, as shown in FIGS. 3A and 3B. The bearing member can be any suitable type of bearing, such as, for example, a ball bearing set including one or more ball bearings, a double row ball bearing set, or slip surface washer(s).

As further shown in FIG. 1A, the hanger further comprises a pair of lateral openings 608 (only one side is shown), which are configured to allow securing of a pair of adjustable axle bodies 700A and 700B. Each adjustable axle body 700A or 700B comprises a respective axle core portions 706A and 706B, a first rod portions 702A and 702B (i.e., wheel coupling members) having a threaded tips 704A and 704B, a second rod portions 708A and 708B (i.e., axle coupling members) having a threaded tip 710A and 710B. As shown, the first rod portions 702A and 702B are offset from respective second rod portions 708A and 708B, about the respective axle core portions 706A and 706B. In other words, the first rod portions 702A and 702B and the second rod portions 708A and 708B extend along different axes. That is, first rod portions 702A and 702B extend along a first axis 720 and second rod portions 708A and 708B extent along a second axis 722, where the first axis 720 is parallel to the second axis 722. Additionally, similar to the kingpin 400 in embodiments, each of the adjustable axle bodies 700A and 700B comprises a straight edged lip portion 712 (only one side is shown), which is configured to mate with (i.e., snugly fit into) a corresponding straight edged groove 626 (only one side is shown) formed at each lateral opening 608. As will become more apparent with respect to FIGS. 6A to 7D, in addition to locking rotation of the adjustable axle bodies 700A and 700B with respect to the hanger 600, the straight edged lip portion 712 along with the offset nature of the first rod portions 702A and 702B and the second rod portions 708A and 708B, can also provide rake and ride height adjustment capabilities to the truck assembly 12. In embodiments, hanger 600 can allow for positive, negative, or neutral rake due to aspects of adjustable axle bodies 700A and 700B as used, and embodiments can provide a low ride height, for example using a rake as low as three millimeters, or another rake of a smaller or larger amount.

Figure 1B:
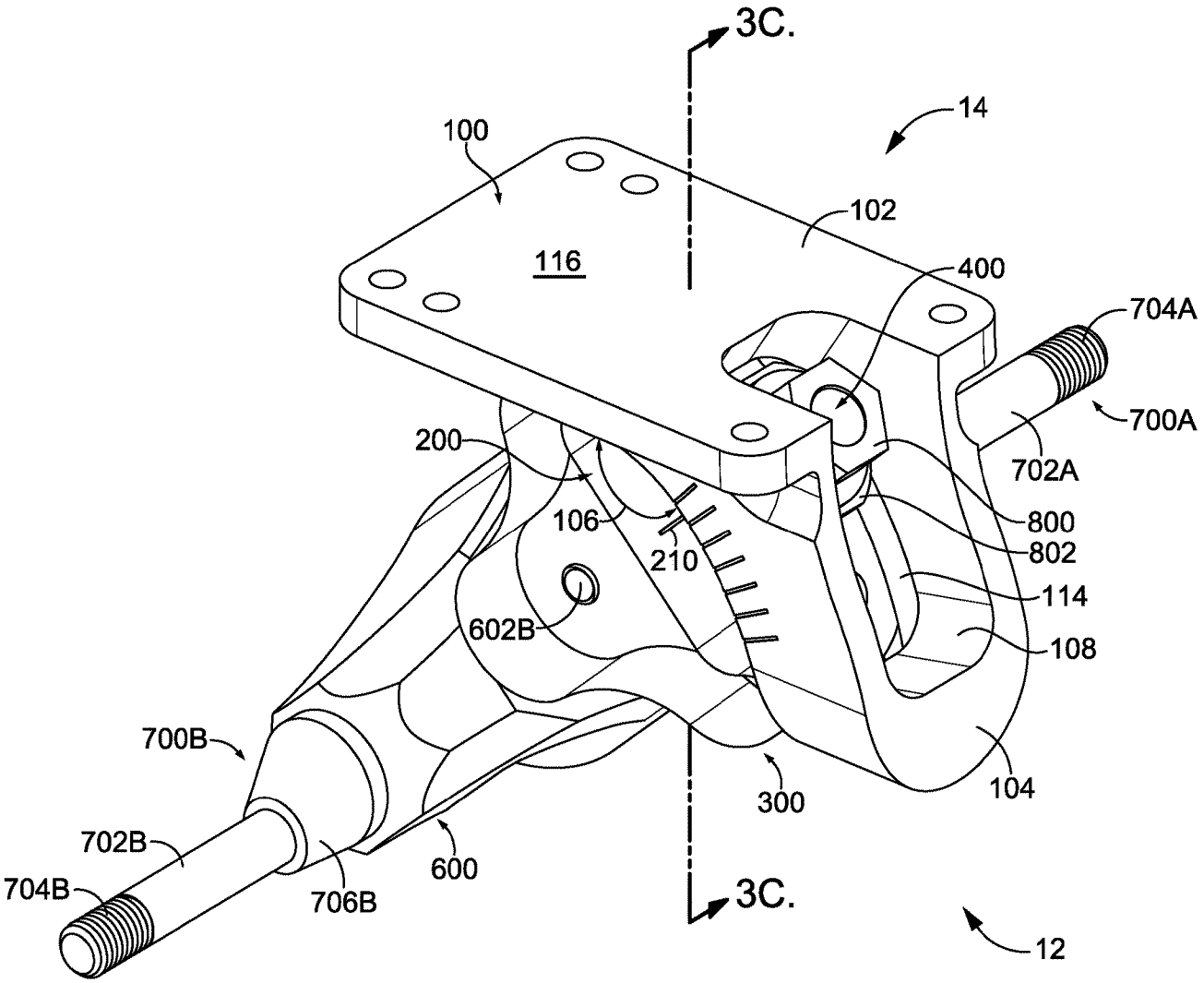
FIG. 1B depicts a first perspective view of the assembled skateboard truck in FIG. 1A, in accordance with aspects herein.

FIG. 1B depicts a perspective view 14 of the illustrative assembled truck assembly 12 shown in FIG. 1A. FIG. 1*b* shows an exemplary base plate 100 including a mounting plate 102 and an interface surface 116. Angled coupling member 104 is shown in the example in FIG. 1A, along with angle 106, cavity 108, and open track 114. An adjustable member 200 and a compressible member 300, in accordance with embodiments, are shown in FIG. 1A. Compressible member 300 can receive pin 602B of hanger 600, as shown. A kingpin 400 is also shown, which can be used to join the components together, for example hanger 600 and base plate 100. FIG. 1B shows a nut 800 and washer 802, which can fix the adjustable member 200 to the base plate 100 in embodiments. FIG. 1A also illustrates line 3C through the assembly shown in FIG. 1A, along which the view in FIG. 3C is formed. FIG. 1B shows exemplary adjustable axle bodies 700A and 700B extending in two directions from hanger 600. Each of the adjustable axle bodies 700A and 700B include first rod portions 702A and 702B, as shown in this example. The first rod portions 702A and 702B can include threaded tips 704A and 704B, as shown at or near the distal ends of first rod portions 702A and 702B, in embodiments. An axle core portion 706B associated with first rod portion 702B is also shown in FIG. 1B.

Figure 2A:
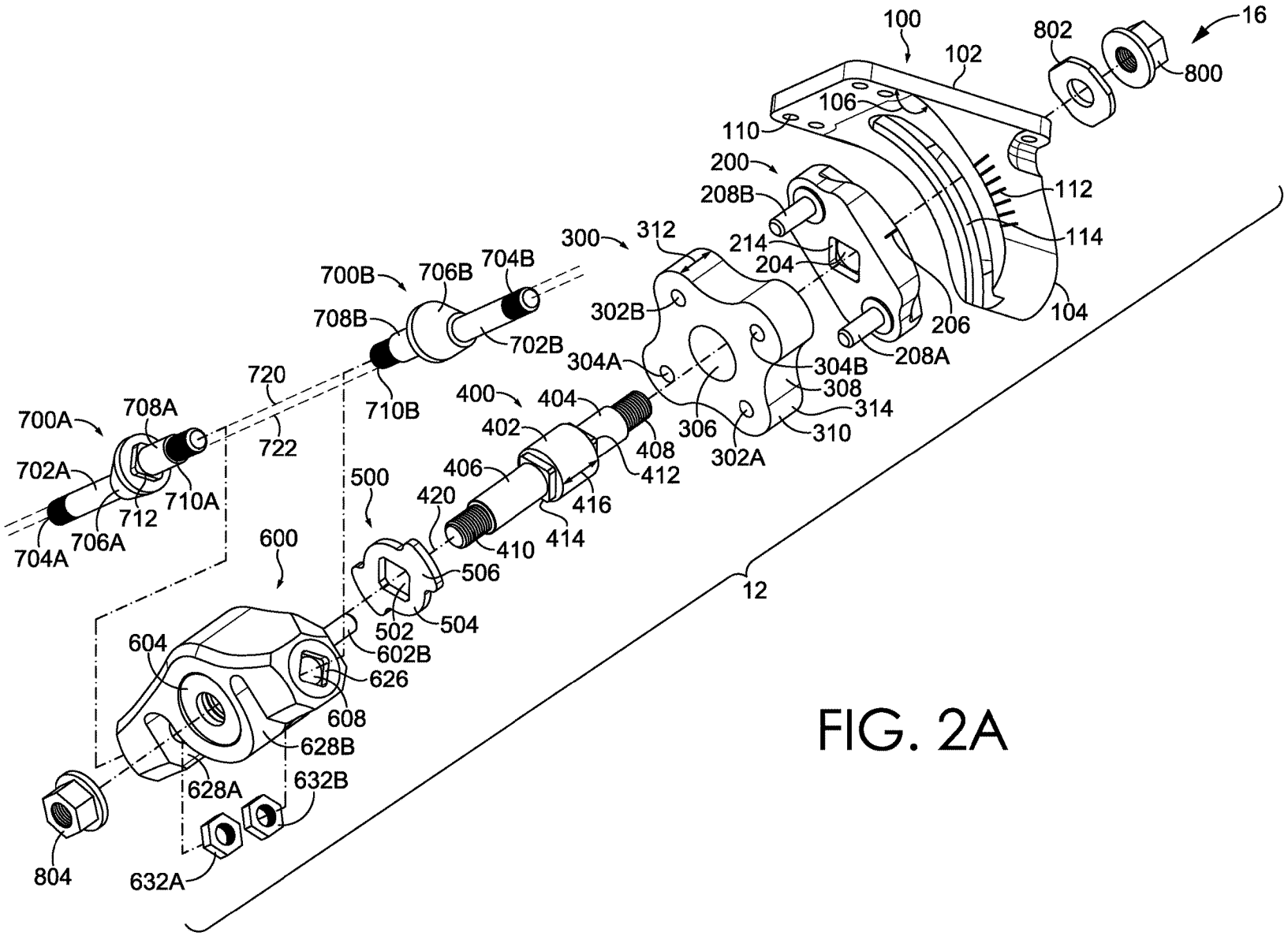
FIG. 2A depicts a second isometric assembly view of the skateboard truck, in accordance with aspects herein.
Figure 3C:
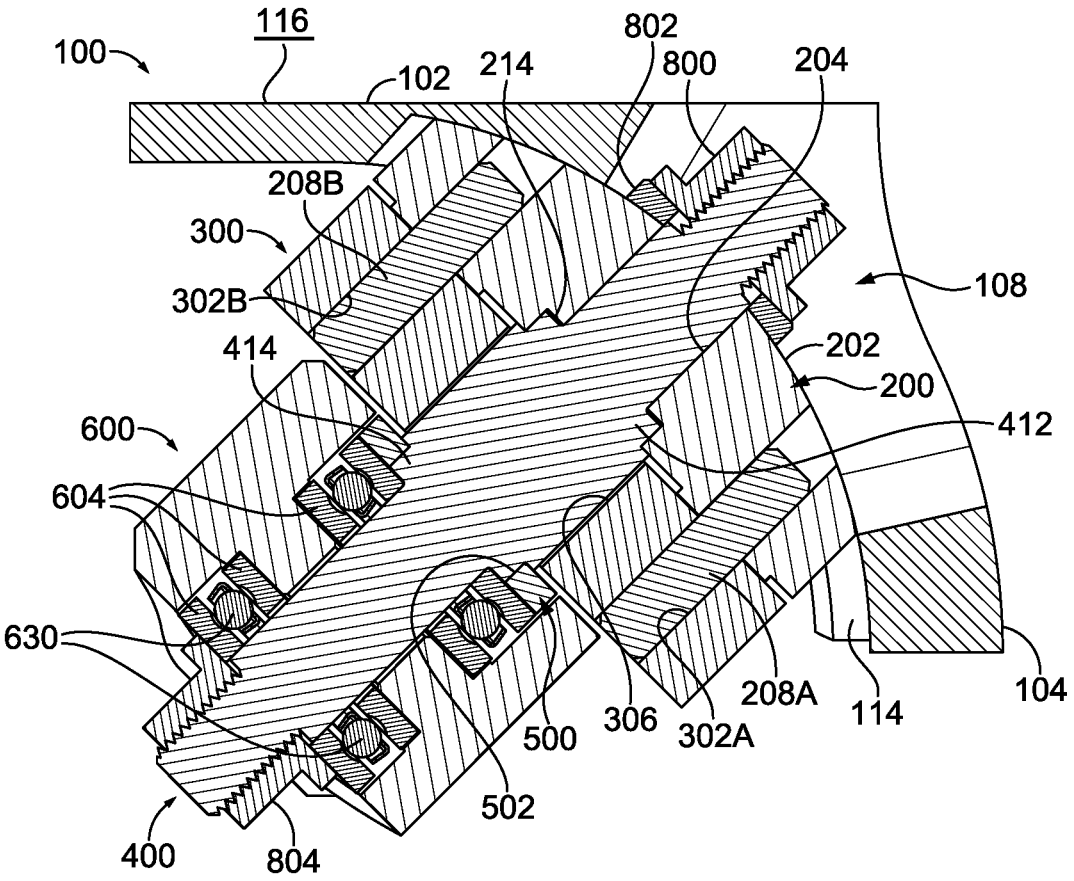

FIG. 2A shows an isometric assembly view 16 of a truck assembly 12 in accordance with embodiments. As shown near the right side of FIG. 2A, a base plate 100 includes mounting plate 102 and an angled coupling member 104, which corresponds to angle 106. Also as shown, base plate 100 can include openings 110 and positional markings 112, along with an open track 114. An adjustable member 200 is shown to the left of base plate 100 in the view in FIG. 21, with adjustable member 200 including, in this example, a central opening 204 and an indicator marking 206. Adjustable member 200 can also operate with a pair of pins 208A and 208B, for example with one of each of the pair of pins 208A and 208B on either side of a central opening 204. As shown in this example, a central opening 204 can be a generally square shape and can include straight edged groove 214. In other examples, central opening 204 can be any shape with one or more straight edges, such as a hexagon.

Continuing with the example in FIG. 2A, to the left of adjustable member 200 is shown a compressible member 300, which includes openings 302A and 302B (which can be aligned with pair of pins 208A and 208B) and openings 304A and 304B. A compressible member 300 can also include a central opening 306 and, as shown in the example in FIG. 2A, compressible member 300 can include grooves 308 and ridges 310, for instance with a groove such as groove 308 on each side of compressible member 300 and a ridge such as ridge 301 at approximately each corner or apex of a compressible member 300, or in embodiments compressible member 300 includes a series of alternating grooves and ridges (e.g., groove 308 and ridge 310) around a perimeter 314 of the compressible member 300. As illustrated, compressible member 300 may have a thickness 312, which may or may not be uniform throughout compressible member 300.

In FIG. 2A, to the left compressible member 300, is shown an exemplary kingpin 400 including a core portion 402 and first rod portion 404. A second rod 406 is also illustrated in FIG. 2A. The first rod portion 404 includes or is connected to tip 408, which can interact with central opening 306 of a compressible member when assembled. Second rod 406 includes or is integral with tip 410. Kingpin 400 in this example includes a straight edged lip portion 412 and a straight edged lip portion 414, on either side of the core portion 402. A height 416 a core portion and/or of a kingpin 400 is illustrated, along with a longitudinal axis 420, in FIG. 2A. Longitudinal axis 420 is depicted as extending from kingpin 400 to the left, from the perspective shown in FIG. 2A, towards a cam 500. Longitudinal axis 420 is illustrated extending through a central opening 502 of cam 500. Cam 500, in this example, includes circular middle portion 504 and a pair of projections 506 extending from either side of the circular middle portion 504, as shown in FIG. 2A.

Continuing with the exemplary embodiment in FIG. 2A, to the left of cam 500 is an illustrative hanger 600, including an area 604 and a pair of lateral openings 608 (only one shown). Hanger 600, in this example, also includes a straight edged groove 626, as shown around and/or comprising the lateral opening 608 in FIG. 2A. Hanger 600 can also include grooves 628A and 628B, on either side of an area 604, for example, which can receive nuts 632A and 632B. The exemplary hanger 600 in FIG. 2A, via lateral opening 608, can receive or be connected to an axle body 700B, as illustrated, for example by securing or inserting axle body 700B into lateral opening 608, in some cases using a threaded tip 710B. As shown in FIG. 2A, a first rod portion 702B including threaded tip 704B is offset from a second rod 708B, for example at axle core portion 706B. In embodiments, a first rod portion 702B is not parallel to a second rod 708B, with an offset or break in a line between a first rod portion 702B and a second rod 708B occurring at or within an axle core portion 706B, as shown in FIG. 2A.

In this example, another lateral opening (not shown in FIG. 2A, opposite lateral opening 608) can receive or mate with adjustable axle body 700A at or near threaded tip 710A of a second rod 708A, which can also include an axle core portion 706A and a first rod portion 702A with a threaded tip 704A. Adjustable axle body 700A can include a straight edged lip portion 712, for example, which can be any shape that includes one or more straight edges. As with axle body 700B, the first rod portion 702A of adjustable axle body 700A can be offset or not parallel with a second rod 708A. For example, second rods 708A and 708B may be along axis 720 as illustrated, while first rod portions 702A and 704A may be along axis 722, or another axis, which is parallel to but not the same as axis 720. FIG. 2A illustrates an embodiment, which can be assembled or connected as shown along axis 420, including the addition of a washer 802 and a first nut 800 and a second nut 804, for example. One or more aspects of the assembly illustrated by the example in FIG. 2A can used alone or in combination with one or more other aspects to achieve one or more of the benefits of the truck assembly described herein, for example a hanger with one or more features as described herein could be implemented.

Figure 2B:
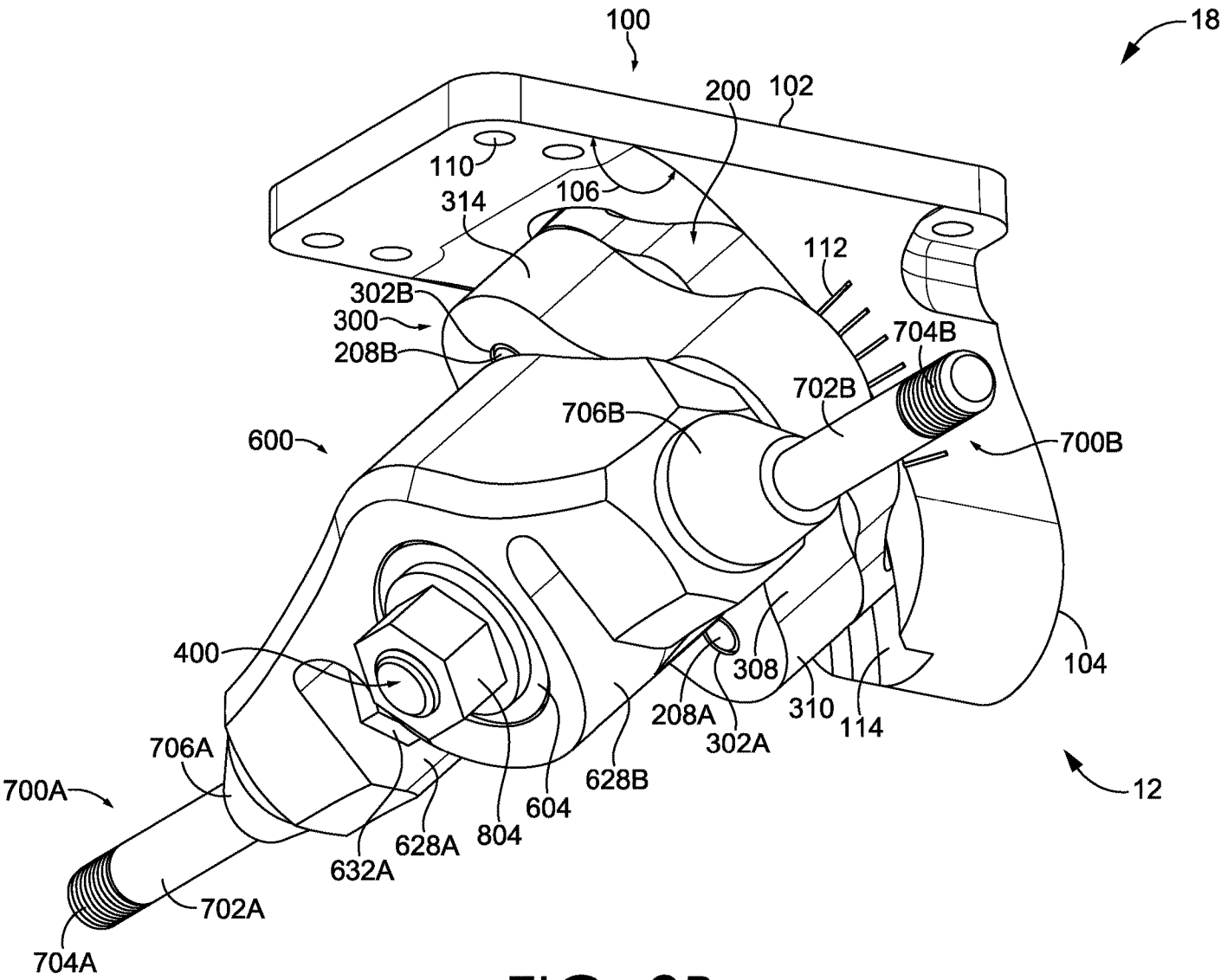
FIG. 2B depicts a second perspective view of the assembled skateboard truck in FIG. 2A, in accordance with aspects herein.

FIG. 2B depicts a perspective view 18 of the assembled truck assembly 12 shown in FIG. 2A. As shown, in FIGS. 2A and 2B, the hanger 600 comprises a pair of grooves 628A and 628B for securing the pair of adjustable axle bodies 700A and 700B to the hanger 600, via respective nut 632A (as shown in FIG. 2B) and nut 632B. This can also be observed from FIGS. 6A and 6B. For example, a threaded tip 710A of a second rod 708A (of adjustable axle body 700A) can interact or be secured with nut 632A after being inserted into one of a pair of lateral openings 608. In embodiments, axle core portion 706A may be against or flush with hanger 600 when adjustable axle body 700A is affixed or connected to hanger 600, as shown in FIG. 2B. FIG. 2B also shows an exemplary compressible member 300 in between a base plate 100 and a hanger 600, secured or connected by kingpin 400. In embodiments, first rod portions 702A, 702B are offset from each other, for example parallel to each other but along different axes. For example, as shown in FIG. 2B, axle core portion 706B can be positioned with respect to hanger 600 in more than one configuration, such that first rod portion 702B is offset, as discussed in more detail below. The position of first rod portion 702B in FIG. 2B can be determined by, for example, one of four possible positions or options for inserting or securing second rod 708B and/or axle core portion 706B, as allowed by a straight edged groove 626. In the example in FIG. 2B, nut 804 is shown at least partially tightened or secured around a portion of kingpin 400, securing hanger 600 to base plate 100.

FIGS. 3A-3C illustrate aspects of embodiments disclosed herein, for example in FIG. 3A an assembly view is shown including an exemplary kingpin 400 is shown in use with a hanger 600 and an adjustable member 200. Kingpin 400 can include tip 408, which can be inserted into or interact with a central opening 306 of a compressible member 300, as shown in FIGS. 3A and 3B. In FIG. 3B, a straight edged lip portion 412 of kingpin 400 is shown within or inserted into a compressible member 300, as fitted or locked by a straight edged groove 214, for example. A straight edge central opening 502 is shown in FIGS. 3A and 3B, as part of cam 500, which becomes flush with or comes into contact with a straight edged lip portion 414 of kingpin 400 when assembled or inserted. Also as illustrated in the embodiment shown in FIGS. 3A and 3B, a kingpin 400, when assembled or used to connect other components, can ultimately be inserted through (and partially extending beyond the far edges of) both a compressible member 300 and a cam 500, for example as shown by kingpin 400 extending beyond cam 500 in FIG. 3 when the straight edge central opening 502 is near or against a straight edged lip portion 414. FIG. 3B also shows a kingpin 400 penetrating or inserted though an adjustable member 200.

FIG. 3C provides a cross-sectional view of aspects shown in FIG. 3B, including an adjustable member 200 that is adjacent to a base plate 100 at mating portion 202 (which is opposite or on the other side of base plate 100 as the mounting plate 102, as shown). An adjustable member 200, for instance, is also shown around kingpin 400, which can be inserted into a central opening 204. In embodiments, bearing member 630 (such as one or more ball bearings or another shape) is used in between or at areas such as area 604 to allow hanger 600 to rotate or to allow hanger to rotate more smoothly. Near base plate 100, nut 800 is shown surrounding the circumference of one end of a kingpin 400. At the other end of the illustrative example in FIG. 3C, the circumference of the other end of the kingpin 400 is secured or surrounded by nut 804, beyond hanger 600, such that hanger 600 and compressible member 300 are affixed beneath a base plate 100, for example by a kingpin 400. Also as shown in this example, openings 302A and 302B can receive a pair of pins 208A and 208B.

Figure 4B:
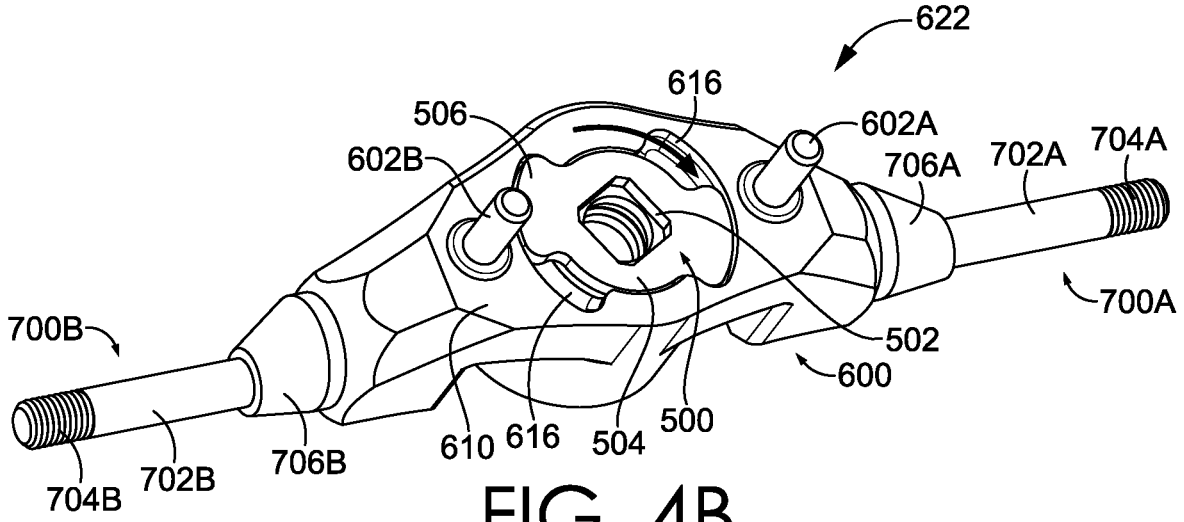
Figure 4C:
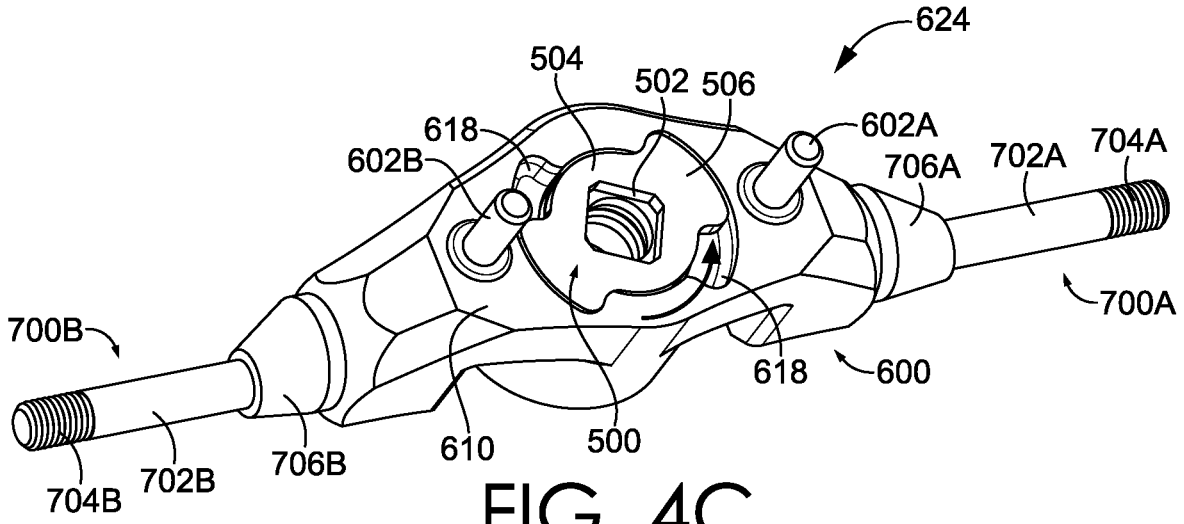

FIGS. 4A-4C depict an exemplary keyed cam system of the skateboard truck assembly, as discussed above. FIG. 4A shows a hanger 600, in an embodiment, including first rod portions 702A and 702B extending from opposite ends of hanger 600, attached to hanger 600 at or near the axle core portions 706A and 706B. Second rod portions 708A and 708B not shown because, in this example, second rod portions 708A and 708B extend inward towards the center of hanger 600, within hanger 600, from the axle core portions 706A and 706B. Near the center of hanger 600 in between pins 602A and 602B, as shown in the example FIG. 4A, is a cam 500 including a circular middle portion 504, which is proximate or adjacent to one or more pairs of gaps 614. The pairs of gaps 614 are on opposite sides of a pair of projections 506, as illustrated in this example. Near the center of cam 500 is a straight edge central opening 502, in embodiments. Cam 500 in FIG. 4A is shown in a neutral state 620, with two (in some cases approximately equivalent) pairs of gaps 615, which can be spaced approximately equidistantly around or near a perimeter or edge of a cam 500 and/or the pair of projection 506.

Turning to FIG. 4B, hanger 600 is shown with cam 500 in a non-neutral state 622, for example with cam 500 shifted or turned clockwise as indicated, such that each pair of gaps 614 as shown in FIG. 4A have been turned into one gap 616 as shown in FIG. 4B. In embodiments, the pair of projections 506 each shift or rotate clockwise into one of the pair of gaps 615 and eliminate all or part of it, while creating two larger, single gaps 616, as shown in the illustrative example in FIG. 4B. In some cases, the pair of projections 506 are turned partially, so that the pair of gaps 614 shown in FIG. 4A become uneven or less equal. In other cases, cam 500 is rotated clockwise as shown in FIG. 4B until the pair of projections 506 can no longer turn, due to no remaining gaps from the pair pf gaps 614 remain in front of the pair of projections 506 so no further rotating is possible, which can lock or secure cam 500 in some cases.

As shown in FIG. 4C, a non-neutral state 624 can exist where cam 500 is turned partially or completely (to the extent allowed by the pair of gaps 614 in FIG. 4A, for example) in the counterclockwise direction. The movement of cam 500, for example to rotate so that a pair of projections 506 shift in a counterclockwise direction, can create two gaps 618, with the two gaps 618 in FIG. 4C being larger than the four gaps shown as the pair of gaps 614 in FIG. 4A. In other examples, the pair of projections 506 are turned counterclockwise but with four gaps still remaining but of uneven size. In embodiments, the configuration or shape of a straight edge central opening 502 as shown in FIG. 4A can determine how far the pair of projections 506 can or must be turned, for example to line up each edge of the straight edge central opening 502. For instance, a cam 500 with a straight edge central opening 502 as shown in FIG. 4A, with four sides in a substantially square shape, may turn further or in larger increments than another straight edge central opening 502 with more or less sides, such as a substantially triangular or hexagonal shape, as examples.

Figure 5B:
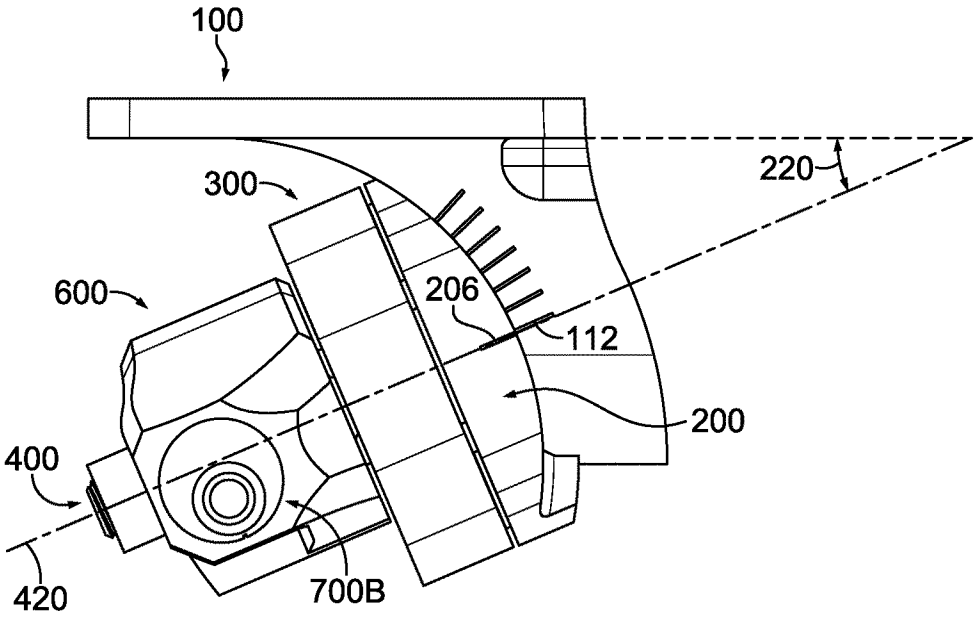
FIGS. 5A-5B depict the adjustable member being coupled to the angled coupling member of the base plate at two different positions, in accordance with aspects herein.
Figure 5A:
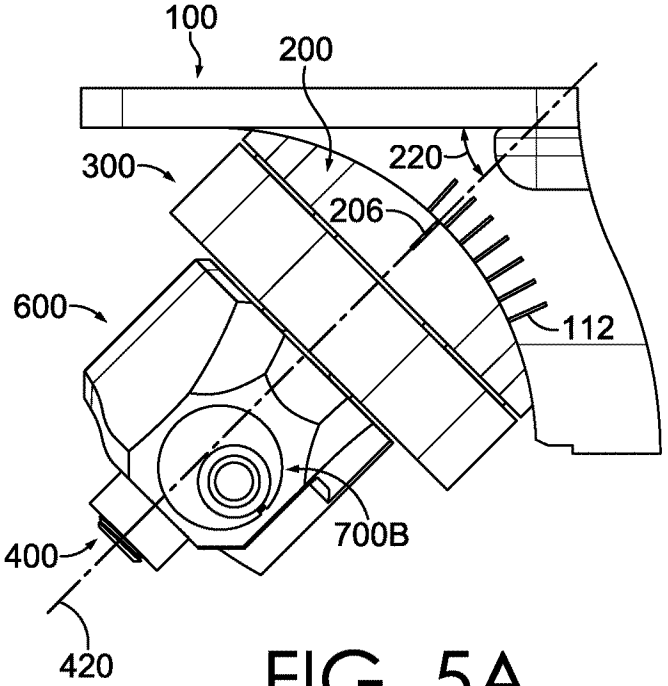

As shown in FIGS. 5A and 5B, the adjustable member 200 allows for the angle 220 formed between the kingpin 400 and the mounting plate 102 and/or the skateboard deck (not shown) to be changed. The changing the angle 220 (i.e., the riding angle) allows a user to customize the feel of the skateboard to their liking. For example, if the user likes a higher degree, as shown in FIG. 5A, the angle 220 formed between the kingpin 400 and the mounting plate 102 is greater, which would make the truck assembly 12 more sensitive when the user tilts the skateboard deck (as illustrated in FIGS. 9A-9D) onto which the truck assembly 12 is mounted. To the contrary, if the user likes a lower degree, as shown in FIG. 5B, the angle 220 formed between the kingpin 400 and the mounting plate 102 is smaller, which would make the truck assembly 12 less sensitive when the user tilts the skateboard deck onto which the truck assembly 12 is mounted. As shown in FIGS. 5A and 5B, the adjustable member 200 can include an indicator marking 206 on, for example, at least one side of the adjustable member 200, which can indicate a position of the adjustable member 200 with respect to the angled coupling member 104, and which can be used to align with (or fall between) a pair of markings such as positional markings 112.

Figure 6A:
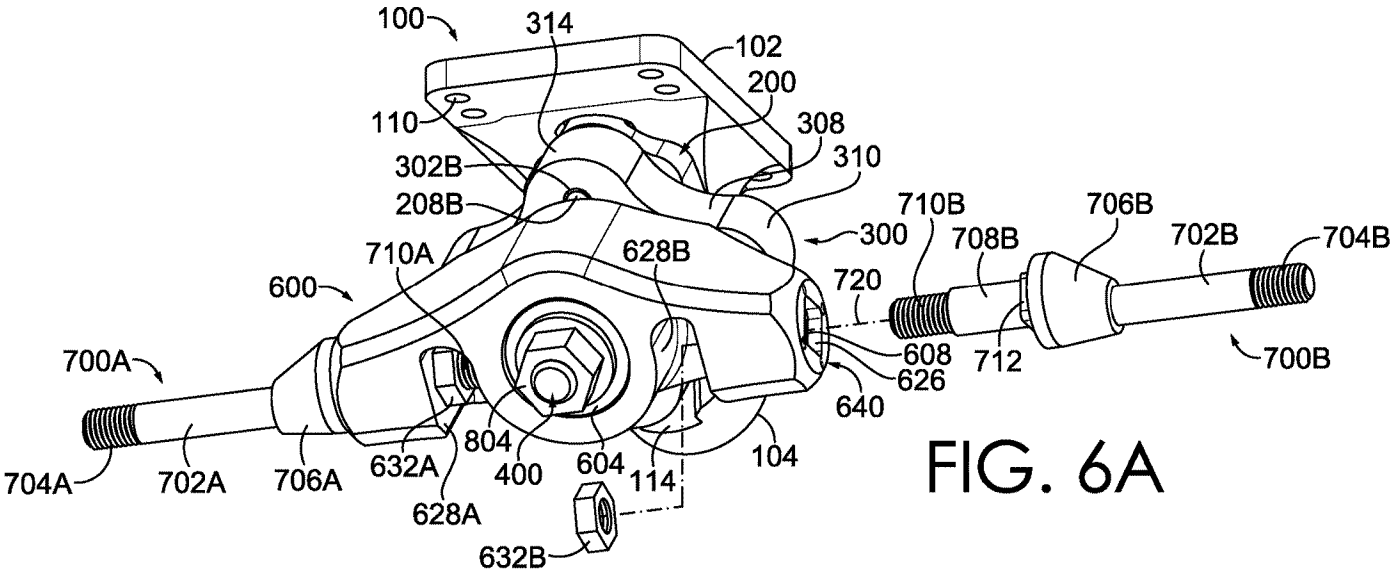
FIGS. 6A-6D depict assembly of the hanger with the pair of adjustable axle bodies, in accordance with aspects herein.
Figure 6B:
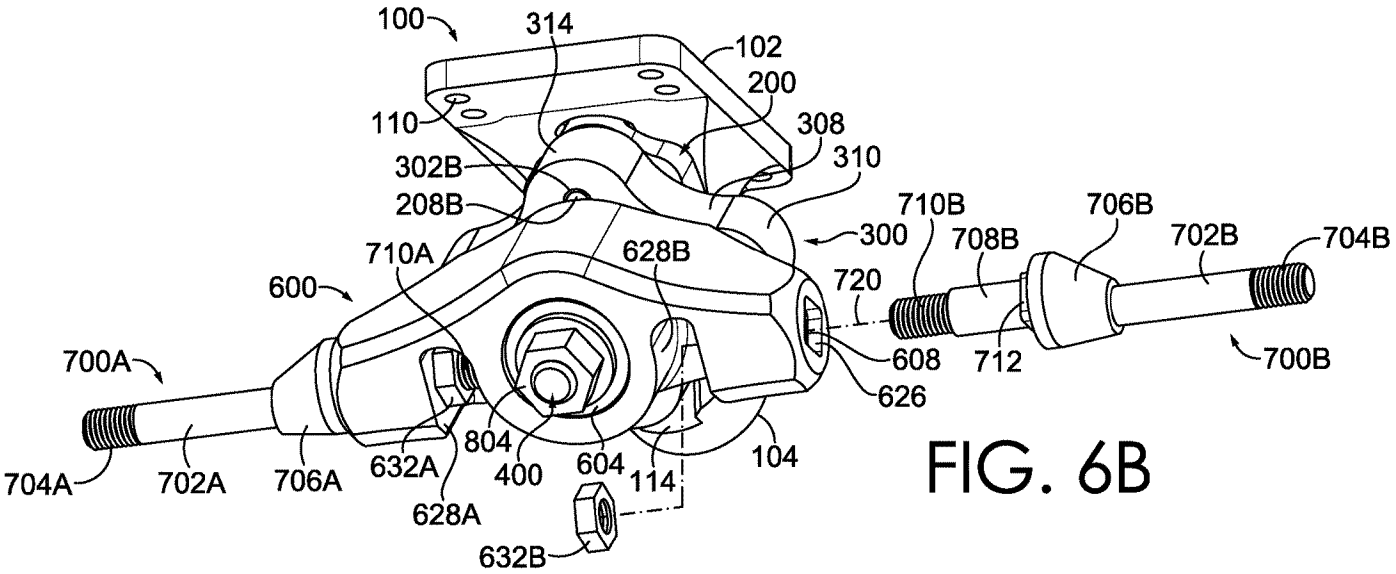
Figure 6C:
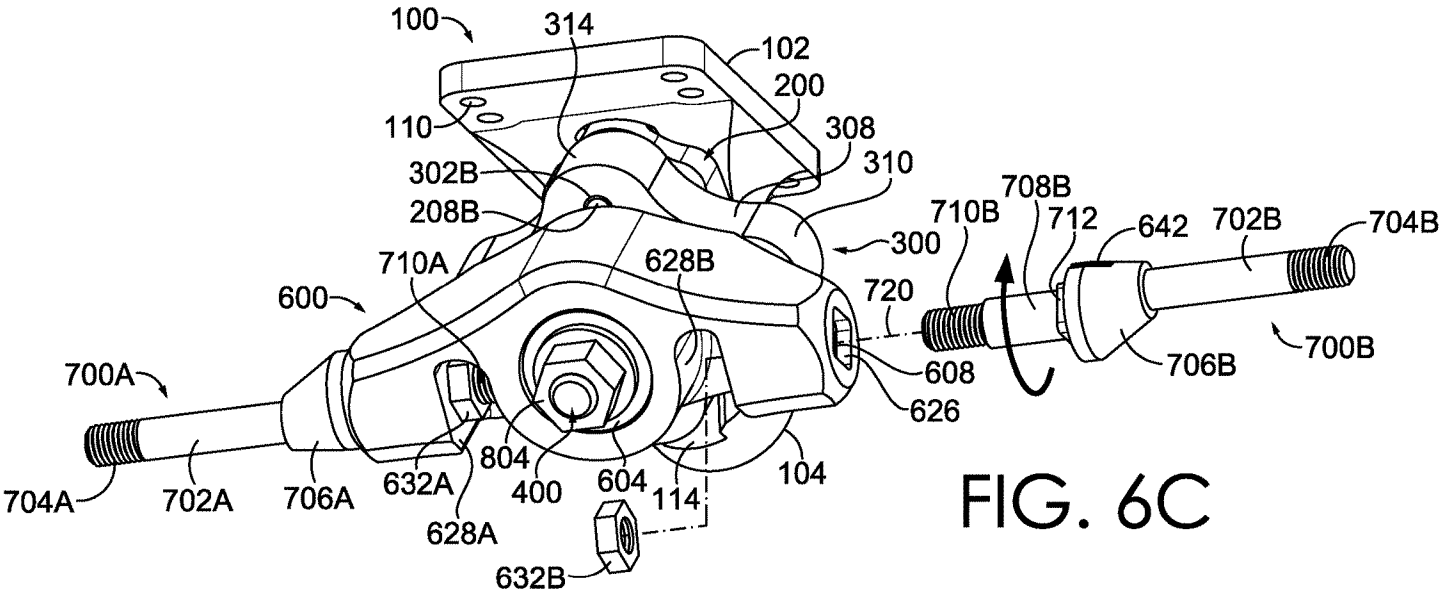

As briefly discussed above, the rake of the truck assembly 12 is also adjustable by changing the position at which the adjustable axle bodies 700A and 700B are fixed to the hanger 600. FIGS. 6A to 6D illustrate an exemplary hanger 600 including, as shown in FIG. 6C, an option to rotate one or more axle bodies such as adjustable axle bodies 700A and 700B prior to joining adjustable axle bodies 700A and 700B to a hanger 600. FIGS. 6A to 6D show embodiments of a hanger 600, for example as secured to a base plate 100, in this case using a kingpin 400, and including a compressible member 300 in between the base plate 100 and the hanger 600. FIGS. 6A to 6B illustrate the attachment of an axle body 700B to hanger 600, but it should be understood that the same attachment aspects including an ability to rotate an axle body applies to adjustable axle body 700A, as well. In embodiments, one adjustable axle body 700B is rotated or adjusted or implemented at an offset, while another adjustable axle body 700A is used at a different rotation or option, with or without an offset. In other embodiments, adjustable axle bodies 700A and 700B are used at the same rotation or placement, for example with the same offset (or lack of offset). As shown in the embodiment in FIG. 6A, nut 632A can secure or attach to tip 710A to affix adjustable axle body 700A to hanger 600, and nut 632B can secure tip 710B after insertion into lateral opening 608.

Figure 6D:
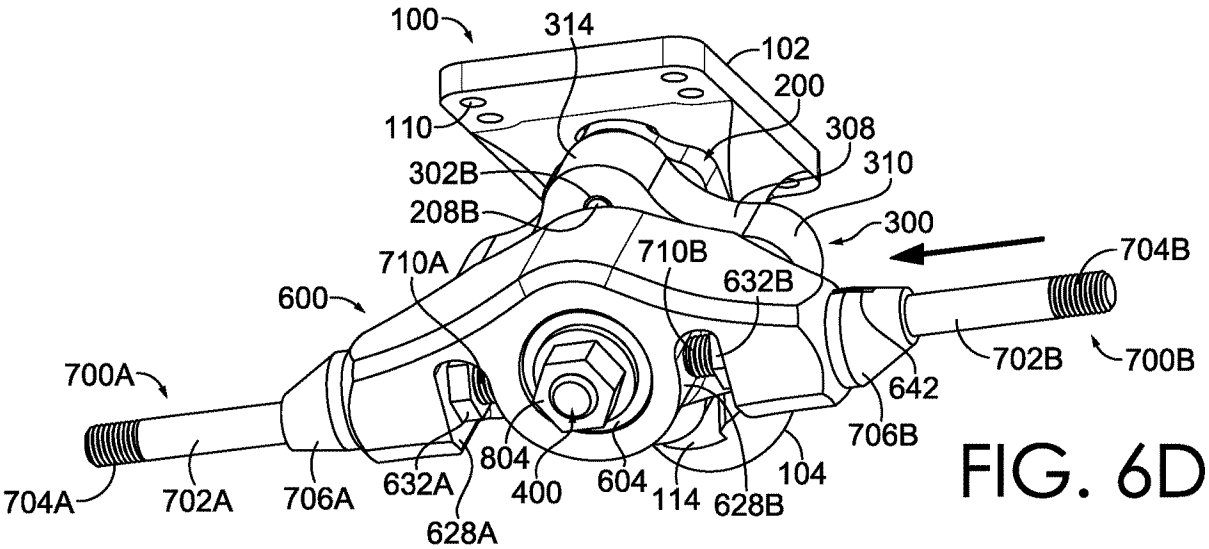

As shown in FIG. 6A, the hanger 600 may comprise markings 640 around the perimeter of each lateral opening of the pair of lateral openings 608. Alternatively, as shown in FIG. 6B, the markings 640 may not be provided. In other words, the markings 640 may optionally be provided in order to provide a guide to the user, however, these markings are not necessary and thus, whether provided or not, the functioning of the truck assembly 12 is not changed or affected. Further, as shown more clearly in FIGS. 6C and 6D, the axle core portions 706A and 706B may also be optionally provided with an axle indicator marking 742 to indicate a specific position for each adjustable axle body 700A and 700B, respectively. Since in the example shown, the straight edged lip portion 712 of each adjustable axle bodies 700A and 700B, respectively, have a four sided shape, the adjustable axle bodies 700A and 700B have four different positions. It is contemplated that any other straight edged geometric shape can be used, such as triangle (three positions), hexagon (six positions), octagon (eight positions), etc., and can be provided to add or reduce adjustable positions for the adjustable axle bodies 700A and 700B, without departing from aspects herein. The adjustment can be made by simply rotating the respective adjustable axle body 700A or 700B being adjusted, about the axis 720 to a desired position, as shown at FIG. 6C, and securing the respective adjustable axle body 700A or 700B by inserting the respective first rod portion 708A or 708B through the respective lateral opening 608, as shown in FIG. 6D.

Figure 7A:
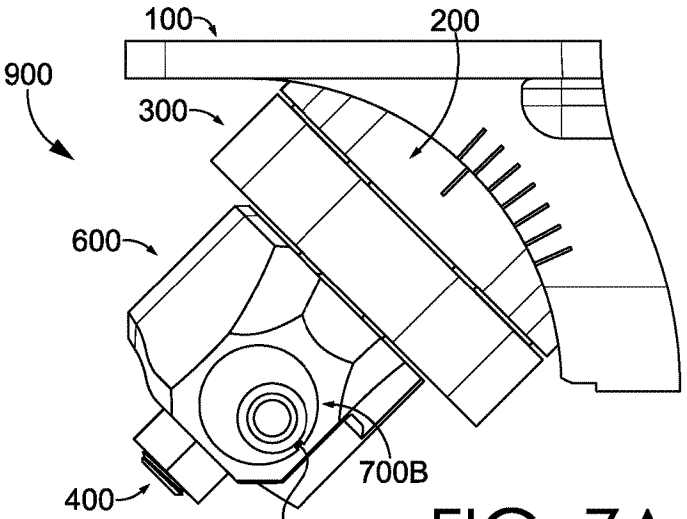
FIGS. 7A-7D depict different positions of the adjustable axle bodies for adjusting the hanger rake, in accordance with aspects herein.
Figure 7B:
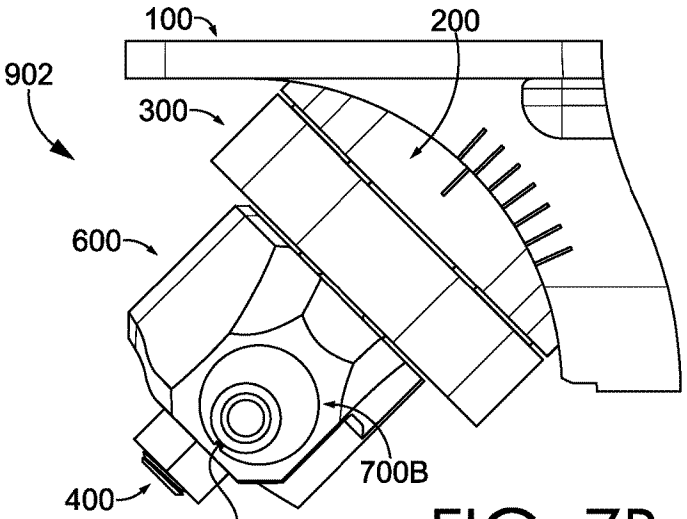
Figure 7C:
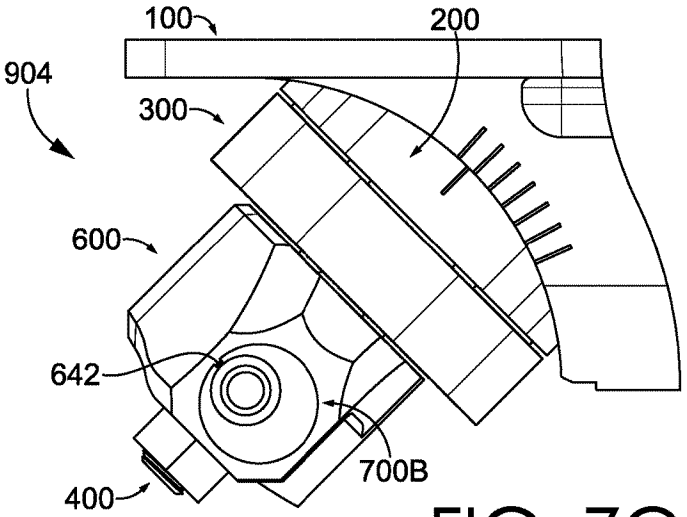
Figure 7D:
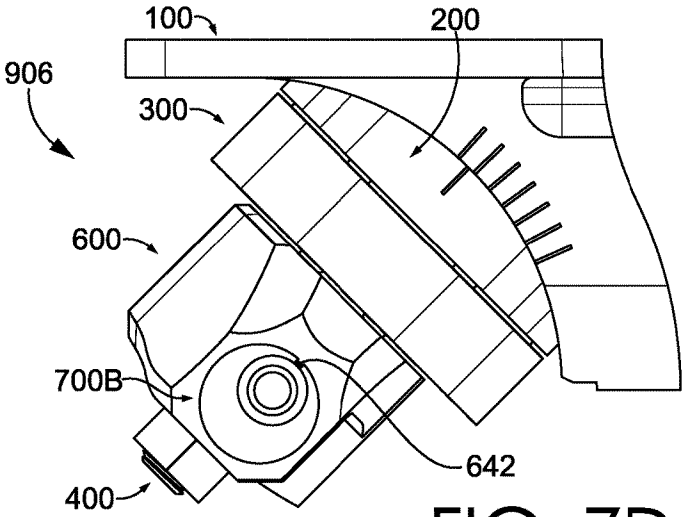
Figure 8A:
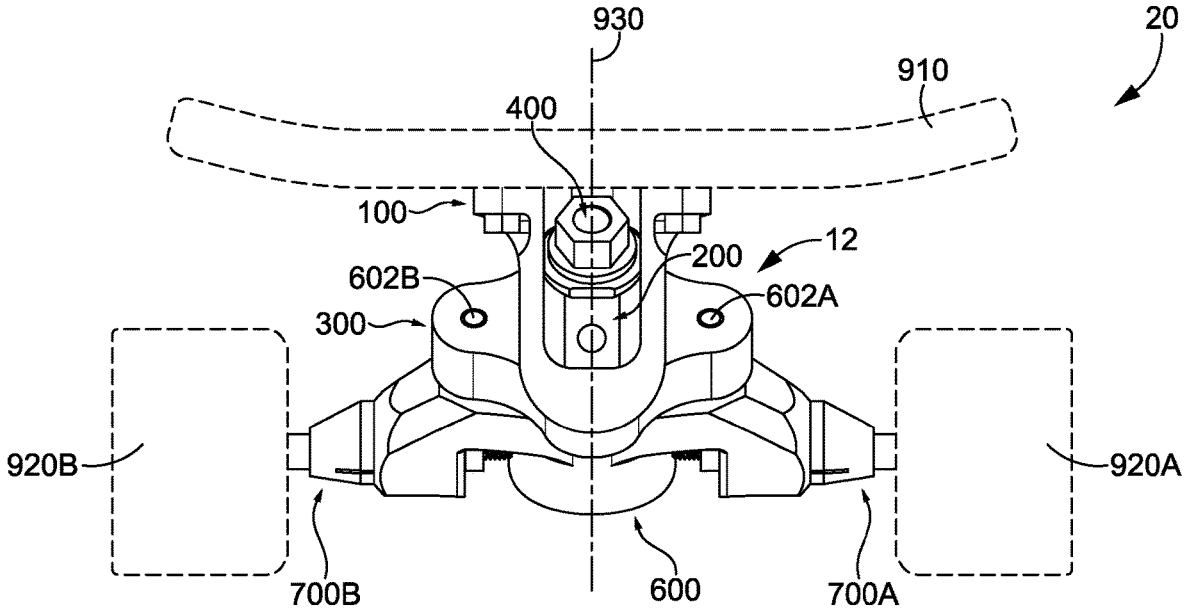
FIGS. 8A-8D depict environmental perspective and cross-sectional views of the skateboard truck as mounted in a neutral state, in accordance with aspects herein.
Figure 8B:
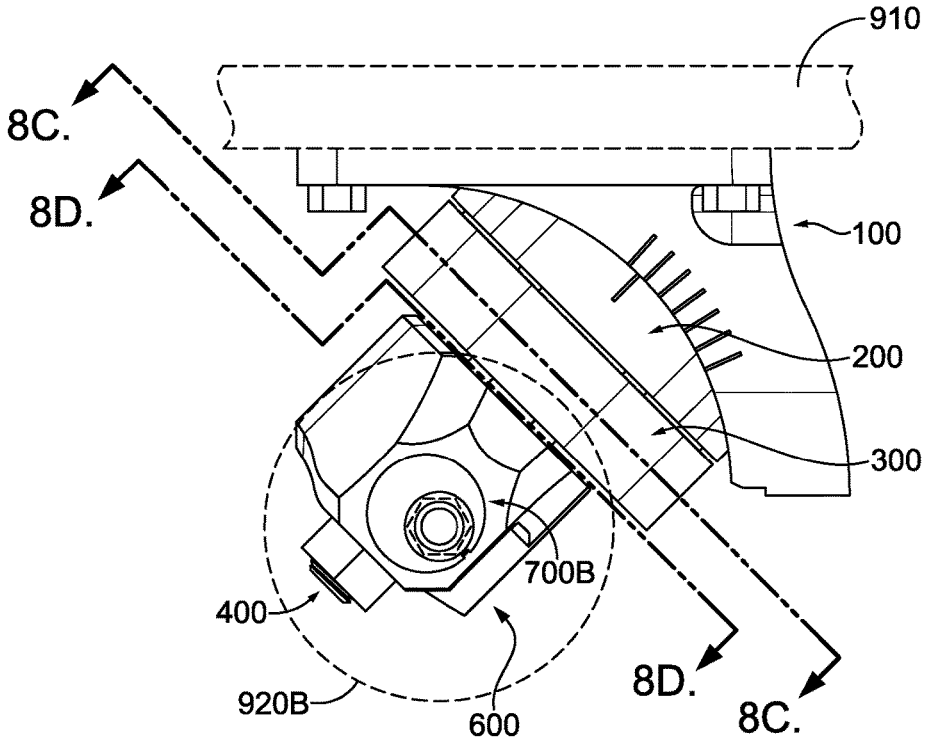
Figure 8C:
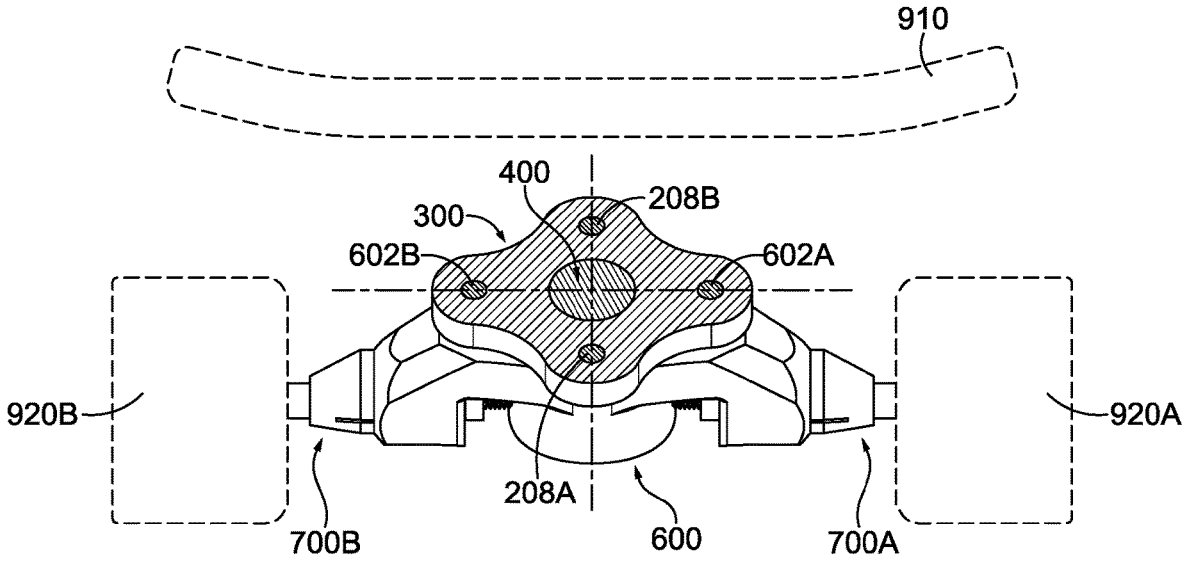
Figure 8D:
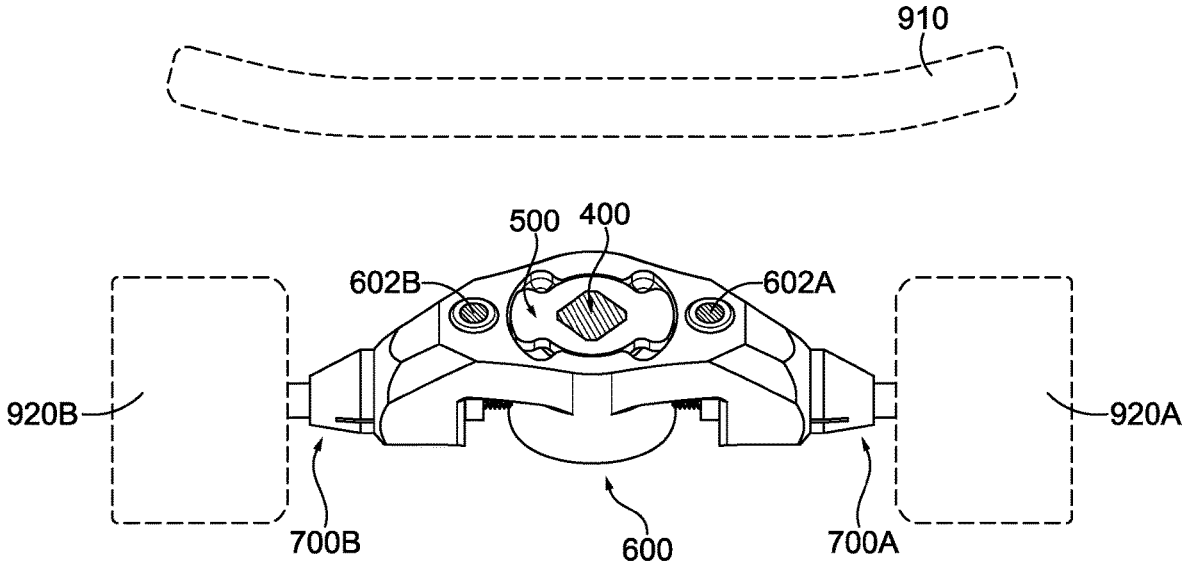
Figure 9A:
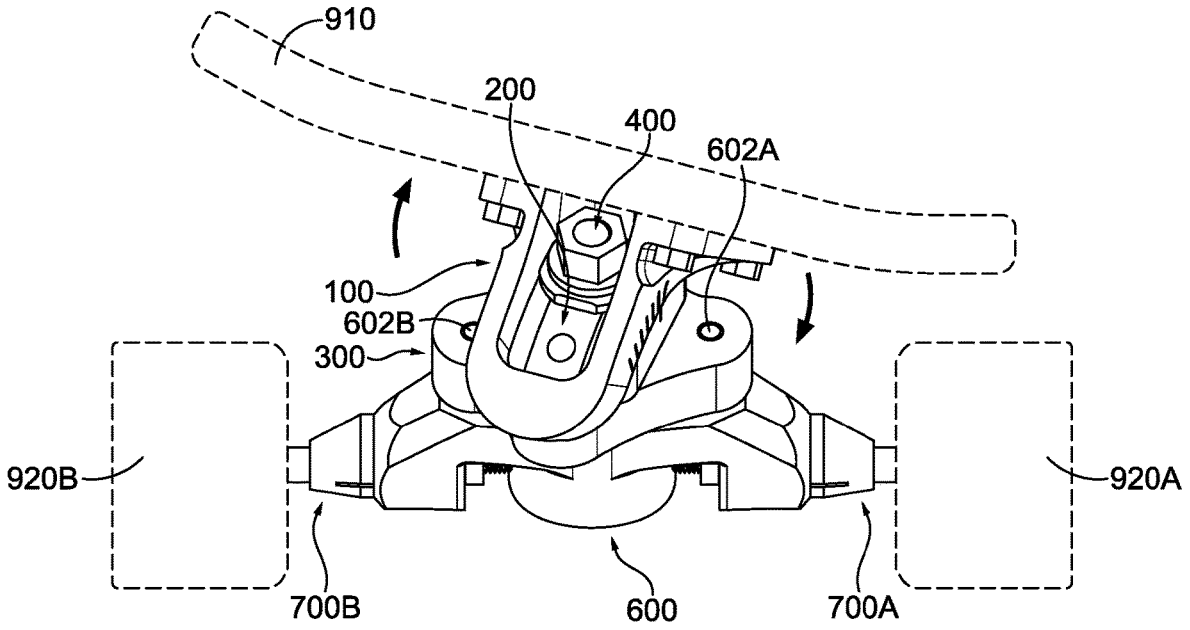
FIGS. 9A-9D depict environmental perspective and cross-sectional views of the skateboard truck as mounted in a turning state, in accordance with aspects herein.
Figure 9B:
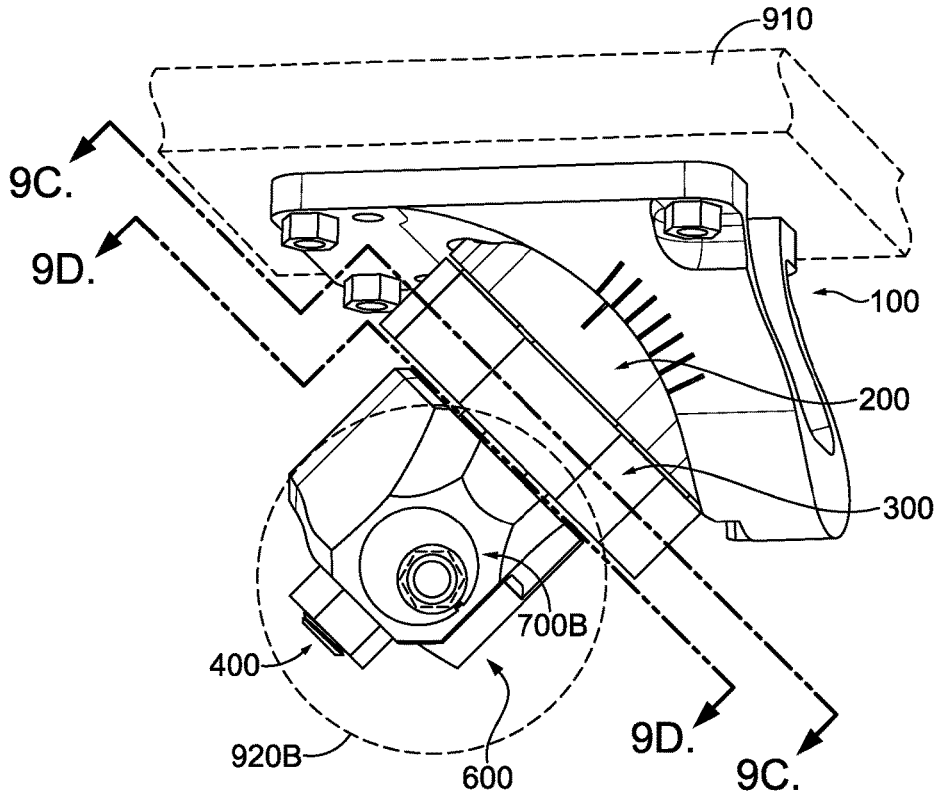
Figure 9C:
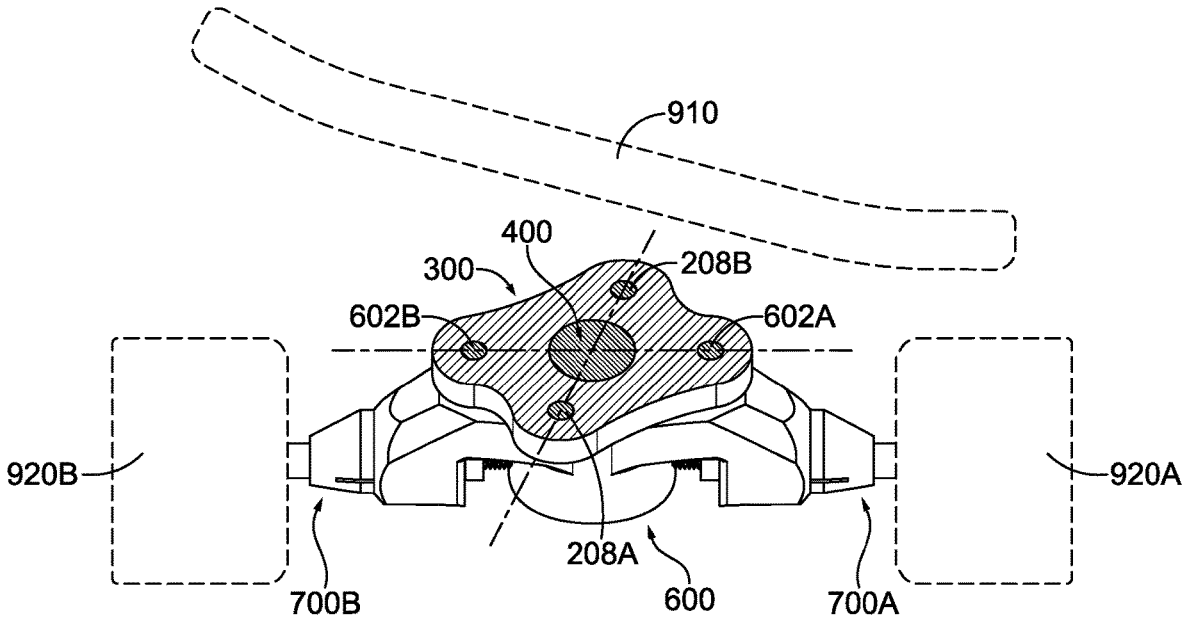
Figure 9D:
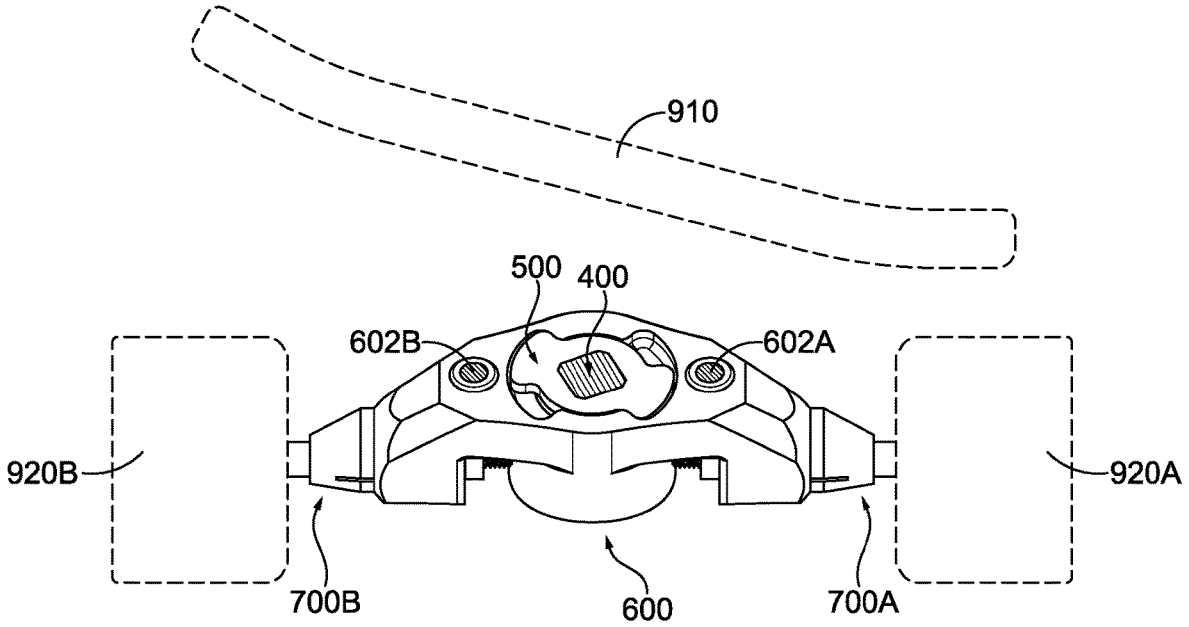

Turning to FIGS. 7A to 7D, illustrative embodiments are shown including a hanger 600 with an axle body 700B connected to or inserted into hanger 600. In each of FIGS. 7A through 7D, a hanger 600 is secured to a base plate 100 (in this case with a compressible member 300 in between the base plate 100 and the hanger 600), using a kingpin 400, for example. FIG. 7A, for example, depicts a first axle body position 900, FIG. 7B depicts a second axle body position 902, FIG. 7C depicts a third axle body position 904, and FIG. 7D depicts a fourth axle body position 906. When axle body 700B is in a first position 900, a point 642 on axle body 700B is shown in a bottom-right location in FIG. 7A. This point 642 is used for illustrative purposes only, to indicate the rotation or differences between each example of an axle body position 900, 902, 904, and 906. Point 642 can also coincide with or be associated with an offset of axle body 700B from a center point, an axis, or another rod portion such as second rod 406, for example, or illustrate that one or more axle body positions of axle body 700B can result in the axle body 700B to extending outwardly from hanger 600 (towards the viewer of FIGS. 7A to 7D) at an offset, for example with respect to hanger 600 and/or with respect to another adjustable axle body 700A. When axle body 700B is in a second axle body position 902, as shown in FIG. 7B, the point 642 is in a bottom-left location, from the perspective in the example in FIGS. 7A to 7D. Continuing with FIG. 7C, when axle body 700B is in a third axle body position 904, point 642 is in an upper left location, and when axle body 700B is a fourth axle body position 906, point 642 can be in an upper right location.

Adjustable axle body 700A can likewise be used in various positions as illustrated regarding axle body 700B in FIGS. 7A to 7D. One or more positions of an axle body 700B can be combined with one or more positions of an adjustable axle body 700A, for example to cause adjustable axle bodies 700A and 700B to extend from hanger 600 at an offset from each other or from hanger 600. For example, an axle body 700B can be in a second axle body position 902 as shown in FIG. 7B, while an adjustable axle body 700A, extending in the opposite direction from hanger 600, can be in any position, for example a third axle body position (e.g., third axle body position 904 as illustrated for axle body 700B). In embodiments, a straight edged lip portion 712 can be a shape with four sides, corresponding to four positions such as those illustrated in FIGS. 7A to 7B. A straight edged lip portion 712 can have more or less sides, in some cases, which can result in more or less axle body positions. In embodiments, one or more axle bodies, such as adjustable axle bodies 700A and 700B, can be made stainless steel or an alloy, and hanger 600 can be aluminum, for example an aluminum used for aircraft applications such as 7075-T6. In embodiments, a kingpin 400 and/or adjustable axle bodies 700A and 700B can be made of one or more materials such as a metal or alloy, including, for example a stainless steel such as a 17-4 grade stainless steel.

Referring now to FIGS. 8A-8D, front environment view 20 of the truck assembly 12 as mounted onto a skateboard deck 910 configured according to one or more embodiments of the present invention, is provided. The lines 8C and 8D in FIG. 8B correspond to the cross-sectional views shown in FIGS. 8C and 8D. For example, all or part of a base plate 100 can be directly or indirectly mounted or otherwise affixed to a skateboard deck 910, and one or more aspects of adjustable axle bodies 700A and 700B can connect to or be used with aspects of wheels 920A and 920B, respectively. For example, as shown, each adjustable axle body 700A and 700B is configured for mounting a respective wheel 920A and 920B. It is to be understood that each skateboard deck 910 is generally mounted with two truck assemblies with at least one of them including truck assembly 12, as shown. When mounted, the kingpin 400 is generally aligned with a central longitudinal axis 930 of the skateboard deck 910. In some cases, a skateboard deck 910 may be mounted or secured to a compressible member 300 and/or a hanger 600, with the aid of a kingpin 400 or not, without a base plate 100 and/or without a compressible member 300.

In some embodiments, skateboard deck 910 can be a standard deck having a length in the range of from about 24 to about 36 inches, or from about 28 to about 36 inches, while in other embodiments, skate deck 30 can be a longboard deck having a length in the range of from about 37 to about 70 inches, about 40 to about 65 inches, or about 42 to about 48 inches. In embodiments, skateboard deck 910 can be longer or shorter than these ranges, for example less than 24 inches or greater than 70 inches, for example. The skateboard deck 910 can have a variety of widths and/or thicknesses and can be constructed of any suitable material in any desirable shape or profile.

As further shown in FIGS. 8A-9D, the hanger 600 of each truck assembly 12 is configured to transition between a resting position (FIGS. 8A-8D) and a turning position (FIGS. 9A-9D), in order to turn a skateboard from a generally aligned (straight) path of travel, to an altered (directional) path of travel. The lines 9C and 9D in FIG. 9B correspond to the cross-sectional views shown in FIGS. 9C and 9D. In operation, a user riding the skateboard can turn the skateboard by exerting a downward force toward one side of skateboard deck 910 (usually by shifting his or her weight in some manner), thereby depressing that side of skateboard deck 910 and at least partially causing the rotation of hanger 600, as illustrated in FIGS. 9A-9D. As a result, the hanger 600 of each truck assembly 12 shifts into a turning position. For example, as shown in FIG. 8D, cam 500 has not turned and is in a neutral position, while in FIG. 9D, cam 500 has shifted in a clockwise direction to a non-neutral position.

When mounted on a skateboard deck, typically, the front hanger rotates in one direction and the back hanger rotates in a similar, but generally opposite, direction, thereby shifting the path of travel of (e.g., turning) the skateboard deck 910. Once the turn is complete, the user can re-position his or her weight, straightening skateboard deck 910 back to a resting position, as generally shown in FIGS. 8A-8D, which returns the skateboard to an aligned (straight) path of travel. In some embodiments, the use of one or more truck assemblies 12, as described herein, can provide customization power to a user of a skateboard. The truck assemblies 12 in accordance with aspects herein provide flexibility and improved performance, while still maintaining a desired degree of stability and safety.

In embodiments, an adjustable truck assembly 12 includes a base plate 100 configured to be mounted to a skateboard deck 910. The base plate 100 can include one or more of a mounting plate 102, and an angled coupling member 104 extending from the mounting plate 102, where the angled coupling member 104 is a track. The assembly also includes an adjustable member 200, in embodiments, having a mating portion on a first surface of the adjustable member 200 and one or more pins extending from a second surface of the adjustable member 200, with the first surface opposite the second surface, a compressible member 300, a cam 500, and a hanger 600. Hanger 600 can include a first surface having one or more pins offset from the one or more pins extending from the adjustable member 200, and a groove 606 centered within the hanger 600, which can house the cam 500. In embodiments, a second surface of hanger 600 includes a second groove, such as area 604, centered within the hanger, wherein this second groove is configured to house one or more bearing member such as bearing member 630. Hanger 600 can include a pair of lateral openings 608, a pair of adjustable axle bodies 700A, 700B configured to mount on the hanger 600 via the pair of lateral openings 608, and one or more kingpins 400 configured to secure the base plate 100, the adjustable member 200, the compressible member 300, the cam 500, and the hanger 600 to each other.

In some cases, an adjustable member 200 can be secured to the angled coupling member 104 of the base plate 100 at one or more positions along the track. The one or more positions along the track can change an angle formed between the kingpin 400 and the mounting plate 102, in some cases. A kingpin 400 can orthogonally intersect at least a first surface and the second surface of the hanger 600. In embodiments, hanger 600 is configured to be rotated along an axis defined by a longitudinal axis 420 of the kingpin 400. In embodiments, the hanger 600 comprises a centered opening such as a straight edged central opening 502 configured to receive the kingpin 400. In some cases, an angled coupling member 104 extends from the mounting plate 102 at an angle between 0° and 90°. In embodiments, a compressible member 300 is comprised of an elastomer and comprises a non-circular symmetrical shape, in some cases a non-circular symmetrical shape comprised of grooves 308 and ridges 310 around its perimeter 314, which can be a quatrefoil shape with grooves and/or have rounded grooves, for example.

In some exemplary embodiments, each of the pair of adjustable axle bodies 700A, 700B comprises an axle coupling member (e.g., rod portions 708A and/or 708B) extending from a first surface of an axle core member (e.g., axle core portions 706A and/or 706B), and a wheel coupling member (e.g., wheel coupling members 702A and/or 702B) extending from an opposite second surface of the axle core member. For example, the axle coupling member and the wheel coupling member can be offset from each other; an axle coupling member can include a straight edged lip portion 712 extending from the first surface of the of the axle core member; the hanger 600 can also include a pair of straight edged grooves aligned with a respective lateral opening of the pair of lateral openings 608. In embodiments, the straight edged lip portion 712 of the axle coupling member is configured to fix a position of the wheel coupling member (e.g., 702A) with respect to the hanger 600 by being fitted into a respective straight edged groove such as straight edged groove 626 of the pair of straight edged grooves. In embodiments the first groove 606 comprises a first shape, for example a first circular middle portion 610 and at least one projection (e.g, one of a pair of projections 612) extending from the first circular middle portion.

In some cases, the cam 500 comprises a second shape having a second circular middle portion configured to fit into the first circular middle portion of the first shape (for example into the circular middle portion 610 of hanger 600), and at least one projection (e.g., one of a pair of projections 506) extending from the second circular middle portion, where the at least one projection of the second shape is narrower than the at least one projection of the first shape to form a gap between the at least one projection of the first shape and the at least one projection of the second shape. Embodiments include an adjustable truck assembly where the gap is configured to limit rotation of the hanger 600 about an axis defined by a longitudinal axis 420 of the kingpin 400. In some cases, a hanger 600 includes a first surface having one or more pins extending therefrom and a first groove centered within the hanger, where the first groove is configured to house a cam 500, and a second surface having a second groove centered within the hanger, where the second groove is configured to house a bearing member 630, and a pair of lateral openings 608.

In some examples of a hanger 600, a pair of adjustable axle bodies 700A, 700B are included and comprise an axle coupling member extending from a first surface of an axle core member, and a wheel coupling member extending from an opposite second surface of the axle core member. The axle coupling member and the wheel coupling member are offset from each other, in embodiments, as shown. An axle coupling member can include a straight edged lip portion extending from the first surface of the of the axle core member, and a pair of straight edged grooves aligned with a respective lateral opening of the pair of lateral openings 608. In some cases, a straight edged lip portion of the axle coupling member is configured to fix a position of the wheel coupling member with respect to the hanger by being fitted into a respective straight edged groove of the pair of straight edged grooves. In embodiments, a kingpin opening such as straight edged central opening 502 is configured to receive a kingpin 400.

As stated herein, aspects of embodiments of the present invention can be implemented in whole or in part, in isolation, modularly, or in combination, to achieve one or more features illustrated and/or described herein. For example, aspects of a hanger as described herein can be implemented to improve a truck assembly, with or without other aspects such as a compressible member.

The preferred forms of the invention described above are to be used as illustration only, and should not be used in a limiting sense to interpret the scope of the present invention. Obvious modifications to the exemplary embodiment, set forth above, could be readily made by those skilled in the art without departing from the spirit of the present invention. The inventor hereby states his intent or ability to rely on the Doctrine of Equivalents to determine and assess the reasonably fair scope of the present invention as pertains to any apparatus not materially departing from but outside the literal scope of the invention as set forth in the following claims.

The invention claimed is:

1. A hanger assembly comprising:

a pair of lateral openings; and a pair of adjustable axle bodies configured to mount on the hanger via the pair of lateral openings, each adjustable axle body of the pair of adjustable axle bodies comprising an axle coupling member extending from a first surface of an axle core member, and a wheel coupling member extending from an opposite second surface of the axle core member, wherein the axle coupling member and the wheel coupling member are offset from one another.

2. The hanger assembly of claim 1, wherein the axle coupling member comprises a straight edged lip portion extending from the first surface of the of the axle core member.

3. The hanger assembly of claim 2, wherein the hanger further comprises a pair of straight edged grooves aligned with a respective lateral opening of the pair of lateral openings.

4. The hanger assembly of claim 3, wherein the straight edged lip portion of the axle coupling member is configured to fix a position of the wheel coupling member with respect to the hanger by being fitted into a respective straight edged groove of the pair of straight edged grooves.

5. The hanger assembly of claim 3, wherein the first pair of straight edged grooves comprises a first shape.

6. The hanger assembly of claim 5, the first shape having a first circular middle portion.

7. An adjustable truck assembly comprising:

a base plate configured to be mounted to a skateboard deck, the base plate comprising:

a mounting plate, and an angled coupling member extending from the mounting plate;

a compressible member;

a hanger comprising:

a first surface with a first groove;

a second surface having a second groove centered within the hanger, wherein the second groove is configured to house a bearing member; and a pair of lateral openings;

a pair of adjustable axle bodies configured to mount on the hanger via the pair of lateral openings, each adjustable axle body of the pair of adjustable axle bodies comprising an axle coupling member and a wheel coupling member, wherein the axle coupling member and the wheel coupling member are offset from one another; and a kingpin configured to secure the base plate, the compressible member, and the hanger to each other.

8. The adjustable truck assembly of claim 7, wherein the axle coupling member comprises a straight edged lip portion.

9. The adjustable truck assembly of claim 8, wherein the straight edged lip portion is a square shape.

10. A hanger comprising:

a pair of lateral openings;

a pair of straight edged grooves aligned with a respective lateral opening of the pair of lateral openings; and a pair of adjustable axle bodies, wherein each of the pair of adjustable axle bodies comprises an axle coupling member extending from a first surface of an axle core member, and a wheel coupling member extending from an opposite second surface of the axle core member.

11. The hanger of claim 10, wherein the axle coupling member and the wheel coupling member are offset from each other.

12. The hanger of claim 10, wherein the axle coupling member comprises a straight edged lip portion extending from the first surface of the of the axle core member.

13. The hanger of claim 12, wherein the straight edged lip portion of the axle coupling member is configured to fix a position of the wheel coupling member with respect to the hanger by being fitted into a respective straight edged groove of the pair of straight edged grooves.

14. The hanger of claim 13, wherein the pair of straight edges grooves comprise a first shape.

15. The hanger of claim 14, wherein the first shape is square.

* * * * *